US005660515A

United States Patent [19]

Hartsoe

[11] Patent Number: 5,660,515

[45] Date of Patent: Aug. 26, 1997

[54] TRIMMER APPARATUS FOR A BINDERY PROCESS AND METHOD OF MAKE-READY

[75] Inventor: Allen Hartsoe, Maiden, N.C.

[73] Assignee: R. R. Donnelley & Sons Company, Lisle, Ill.

[21] Appl. No.: 601,102

[22] Filed: Feb. 14, 1996

[51] Int. Cl.[6] ..... B42C 13/00

[52] U.S. Cl. ..... 412/1; 412/14; 412/16

[58] Field of Search ..... 412/1, 9, 11, 13, 412/14, 16

[56] References Cited

U.S. PATENT DOCUMENTS

| | | | |
|---|---|---|---|
| 1,744,848 | 1/1930 | Welk | 412/14 |
| 4,436,469 | 3/1984 | Kelly | 412/16 |
| 4,484,501 | 11/1984 | Ramcke | 412/16 X |
| 4,507,037 | 3/1985 | Fenimore | 412/16 X |
| 5,267,821 | 12/1993 | Bodart et al. | 412/14 X |

*Primary Examiner*—Willmon Fridie, Jr.

*Attorney, Agent, or Firm*—Fitch, Even, Tabin & Flannery

[57] ABSTRACT

This invention relates to a trimmer apparatus for cutting book forms collated on a bindery apparatus and more particularly, to an improved make-ready or to set up of the trimmer apparatus to obtain production run speeds of operation.

13 Claims, 26 Drawing Sheets

*Fig. 12a*

67

| POCKET POSITION | 1 | 2 | 3 | 4 | 5 | 6 | 7 | 8 | 9 | 10 | 11 | 12 |
|---|---|---|---|---|---|---|---|---|---|---|---|---|
| POCKET TYPE | | 279 | 279 | 279 | 279 | 279 | 279 | 279 | 279 | | | |
| COMPONENT DESCRIPTION | | 5370 FREE | 5371 10% | 5372 PEEK | 5373 B | 5371 | 5366 T | 5365 T | 5371 INSERT | | | |
| NO. OF PAGES | | | | | | | | | | | | |
| BAR | | 10 1/2 | 10 1/2 | 10 1/2 | 10 1/2 | 10 1/2 | 10 1/2 | 10 1/2 | 10 1/8 | | | |
| POST | | 4 1/8 | 4 1/8 | 4 1/8 | 4 1/8 | 4 1/8 | 4 1/8 | 4 1/8 | 4 1/8 | | | |
| BACKPLATE | | 10 1/2 | 10 1/2 | 10 1/2 | 10 1/2 | 10 1/2 | 10 1/2 | 10 1/2 | 10 1/8 | | | |
| SUCKER TYPE (FEEDER) | | | | | | | | | | | | |
| STOPS | | 210MM | 210MM | 210MM | 210MM | 210MM | 210MM | 210MM | 210MM | | | |
| CAMS | | 50 | 50 | 50 | 50 | 50 | 50 | 50 | 50 | | | |
| SIG OPENING *FRONT* | | | | | | | | | | | | |
| GRIPPER TYPE | | | | | | | | | | | | |
| VACCUM ADJUSTMENT | | | | | | | | | | | | |
| VACCUM STEMS | | | | | | | | | | | | |
| SUCKER TYPE | | | | | | | | | | | | |
| SIG OPENING *BACK* | | | | | | | | | | | | |
| GRIPPER TYPE | | | | | | | | | | | | |
| VACCUM ADJUSTMENT | | | | | | | | | | | | |
| SUCKER TYPE | | | | | | | | | | | | |
| DROP | | 3 7/16 | 10 | 17 1/16 | 1/4" | 7 1/4 | 6 1/8 | 18 9/16 | 7/8" | | | |
| | | | | | | | | | | | | |

| CHAINS | | STITCHES | | TRIMMER | | | | JOB NAME POPCORN | DATE RECORDED 1/1/95 |
|---|---|---|---|---|---|---|---|---|---|
| 90 DEGREE | 10 1/2 | FIRST | 3 | HEAD/FOOT | 10 | PUNCH | | | |
| TRANSFER | 10 1/2 | SECOND | 0 | FACE | 7 3/8 | KNIVES | | JOB NUMBER 71764 | MACHINE # 27 |
| GATHERING | 10 1/2 | THIRD | 3 | BELT | 16-JAN | SUPPORT | | | |
| | | FORTH | | DRIVE | | ROLLER | | | MACHINE SPEED 10,200 |
| | | | | | | | | | |
| | | PROBLEM | | | | | | | |
| STACKER | | | | | | | | | |
| TYPE | | SOLUTION | | | | | | | |
| BUCK WIDTH | | | | | | | | | |
| BUCK LENGTH | | PROBLEM | | | | | | | |
| SIDE JOG | | | | | | | | | |
| STACK SP. | | SOLUTION | | | | | | | |
| | | | | | | | | | |

*Fig. 12b*

TRIMMER APPARATUS FOR A BINDERY PROCESS AND METHOD OF MAKE-READY

FIELD OF THE INVENTION

This invention relates to a trimmer apparatus for cutting book forms collated on a bindery apparatus and more particularly, to an improved make-ready or to set up of the trimmer apparatus to obtain production run speeds of operation.

BACKGROUND OF THE INVENTION

The invention relates to a trimmer apparatus that trims book forms made on a bindery apparatus. The latter has a large number of signature feeding machines (hereinafter called "pocket machines") which feed individual folded sheets or signatures to a gathering conveyor. The gathering conveyor passes beneath the pocket machines and collects the folded sheets which are deposited on a triangular saddle with laps on opposite sides of the saddle. The gathering conveyor receives a systematic superimposition of sheets from the respective pocket machines to create a multi-signature book form. The book form is conveyed on the saddle into and through a stitching machine that stitches the book forms by stapling the book forms with staples. After stapling, the book forms are transported to a trimmer machine which severs the face and sides of the stapled book form.

Such binding apparatus operates at very high production speeds, e.g., 5,000 to 18,000 book forms per hour with the signatures and book forms continuously traveling at high speeds. The number of signatures in a book form varies from a few to a large number—e.g., eighteen (18) signatures or more. Likewise, the number of pages in one signature varies from one to several pages. The size dimensions of the signatures varies from job to job, and the trimmer machine must be reset and properly timed when changing from one size of signature to another size of signature. Currently, the operators of such bindery apparatus are skilled persons who have been trained over an extensive period of time of how to make ready the bindery apparatus for a particular job and then to do initial production runs which require fine adjustments or tweaking of the machines and conveyors to obtain the full production rate of operation of the bindery apparatus. The time used for make-ready and for initial production tweaking is currently very substantial. For example, a typical make-ready operation may take four to twelve (12) or more hours, and the initial production runs with tweaking may last one to twenty-four (24) hours before full production speed is obtained. During the make-ready and initial production runs, the bindery apparatus including the trimmer machine is run with signatures many of which become scrap. It is not uncommon for as much as one-half of one percent of a production run to become scrap during the make-ready and initial production runs.

If a bindery apparatus is not making a production run, it is not making signature book forms; so that a make-ready time of twelve (12) hours will mean twelve (12) hours of lost production. If the production rate is 10,000 book forms per hour, then the production of 120,000 book forms is lost during the twelve hours of make-ready. Also, if the scrap generated is 1,000 book forms, by way of example, then the cost of paper and printing is another significant expense.

The trimmer machine presents problems in make-ready because the scales and other information provided are not very accurate or becomes so inaccurate over a period of time that the scales are no longer used by the operator. For instance, a rotary scale provided at hand wheel for shifting the head and face knives becomes so inaccurate with time that operators use a tape measure to measure the distance between the head and foot knives, rather than using the rotary scale. Likewise, a rotary scale at the hand wheel to adjust the distance between the face stops which engage the fold of the book form and a face cut knife to trim the face become so inaccurate because the face cut knife is sharpened, gears become worn, or play such as backlash occurs, that the operators again use a tape measure rather than the rotary scale. A third rotary scale is provided for timing of the face cut knife operation to the lugs on the infeed conveyors, and for the same reasons, the scale is useless except as a general guide. The operators place sample book forms on the infeed conveyors and adjust the position of the face cut knife to obtain the desired timing. The trimmer is subject to various time-consuming and difficult to make measurements for its use. These operations require machine jogging to test. Also, this results in maladjustments at the trimming machine that require tweaking to correct.

From the foregoing, it will be seen that there is a need for a new and improved method of make-ready of a trimmer machine used in a bindery system. Among these needs is a substantial reduction in variations due to the subjective judgment of operators, in the time lost in tweaking, and in the scrap generated. Further, there is a need to reduce the make-ready time so that the trimmer machine as well as the other components of bindery apparatus are utilized to a greater extent at full production speed than has been done heretofore.

SUMMARY OF THE INVENTION

In accordance with the present invention, there is provided a new and improved trimmer apparatus and method which reduces the amount of make-ready time and waste associated with such trimmer apparatus. This is achieved by providing objective scales or standards having indicia which allow the setting of the apparatus to objective standards, thereby eliminating much of the variation which is caused by operator error or variations in operator subjective judgments. This is also achieved by providing new and improved measuring techniques for providing for the objective location of stops for the book forms and to allow trimming of the face cut knifes based on a measured distance or a known dimension between the folded edge and the trimmed face of the book form.

With the present invention, it is possible to lock out the entire bindery apparatus and to have a number of people each simultaneously performing a separate set-up of a particular piece of apparatus, such as the location of face cut knife to the book form stops and the timing of the trimmer knives relative to its infeed conveyor.

As will be explained in greater detail, the use of objective scales and standards related to the actual trimmed size of the book forms between the fold and the trimmed face will reduce the likelihood of operator error and the time needed for tweaking so that high accuracy is achieved initially.

In accordance with another aspect of the invention, there is provided historical job cards which record the indicia for a particular job being run; so that when the next time the job is being run, a machine can be set up using the same indicia that was used to run the first job. During the first job, there may have been tweaking or slight changes in measurements on the scale, and these would have been recorded on the previous job card or history such that the machine can be set to the final tweaked position, rather than merely the measured position, thereby also saving time.

When beginning a make-ready operation, it is necessary and preferred to set the machine to a predetermined reference point, such as 100° dead center of the Muller timing drive indicator scale and to lock out, that is, stop the trimmer apparatus and prevent any drive or jogging of the machine. When the particular apparatus described herein is locked out at 100°, the trimmer blade in the book form trimmer machine is at its lowest position and the stitcher carriage has completed its forward travel. Thus, at this point the persons can perform their set-up task on the trimmer and on the referencing the lugs or without having to run or jog the machine. This allows as many people as possible to perform make-ready tasks simultaneously without jogging the machine.

In accordance with the present invention, the trimmer may be adjusted simultaneously with the adjustment with the pocket machines, the book form transfer conveyor, the book form double lug chain and the single lug chain. To this end, it is preferred that there be provided a scale which is related to the head assembly and the foot clamp assembly so that the head and foot knives are properly positioned to trim the head and foot based on the size of the signature. For instance, if the desired finished size of the book form is 10", then the foot and head clamp assemblies are simultaneously moved to a 10" mark on the scale, which is preferably attached to the yoke. If the job has been run previously, the head and foot clamps may be moved to the exact position noted on the data sheet or job card for the same job. Thus, the face cut knife and the head cut knife should provide the same cut that was previously done for the same type of signature.

The preferred way of make-ready for the trimmer face cut is to provide a scale and an indicator aligned with the bookstops which locate the book while a face cut is made. Preferably, the indicator is in the form of an additional bookstop on the same bar that carries the normal stops. The indicator stop is shifted to the measured book size between the book fold and the book face. The scale is fixed on the machine relative to the face cutting blade so that the precise position of the cutting blade edge relative to the stops is obtained.

The present invention allows one to measure the book form fold to face cut and to use this measurement to accurately time the cutting by the face knife relative to position of lugs on the infeed conveyor that is delivering book forms into the trimmer machine. With the bindery apparatus locked out at a reference position, the vertical position of a yoke carrying the cutting knives is known. A scale has been provided with indicia located thereon, and an indicator has been provided such that the position of the yoke is shifted manually by operation of a hand wheel relative to the conveyor infeed lug, and then the yoke drive is re-engaged. The height of the yoke is positioned relative to the pusher on the infeed conveyor such that for a longer signature, the yoke will be higher; and for a shorter signature, the yoke will be lower when the chain lugs are positioned (at the reference position) for the trimming of the face cut. With the scale it is possible to set the yoke relative to the chain lugs and then reconnect the yoke and the conveyor to one another so that the distance that the yoke travels is directly related to the size of the signature with the signature abutting the stop when the face cut blade on the yoke is cutting the book form along the face cut edge. The particular relationship allows for a quick and easy timing of the trimmer and eliminates a lot of tweaking because of the objective data used.

It is also preferred to provide an improved, finer resolution scale positioned adjacent the belt tension handle, which moves the belts toward or away from one another on the trimmer. A finer scale of 1/64th gradations is provided so that the belt tension may be maintained much closer than the 1/16" scale heretofore used with the Hans Muller equipment being described herein.

From the foregoing, it will be seen that much of the make-ready can be accomplished even while there are no signatures available. Often, in the past, one had to wait for an hour to an hour and one-half for the actual signatures to be brought to each of the signature feed stations before the set-up could be done. By having a job file and job history, and with the machines locked out at a reference point, e.g., 100°, the measured size or historical data is used to time the trimmer conveyors and trimmer knives without jogging the machine.

BRIEF DESCRIPTION OF THE DRAWINGS

FIG. 12*a* and FIG. 12*b* are an illustration of a job card;

DETAILED DESCRIPTION OF THE PREFERRED EMBODIMENT

Figure 24:
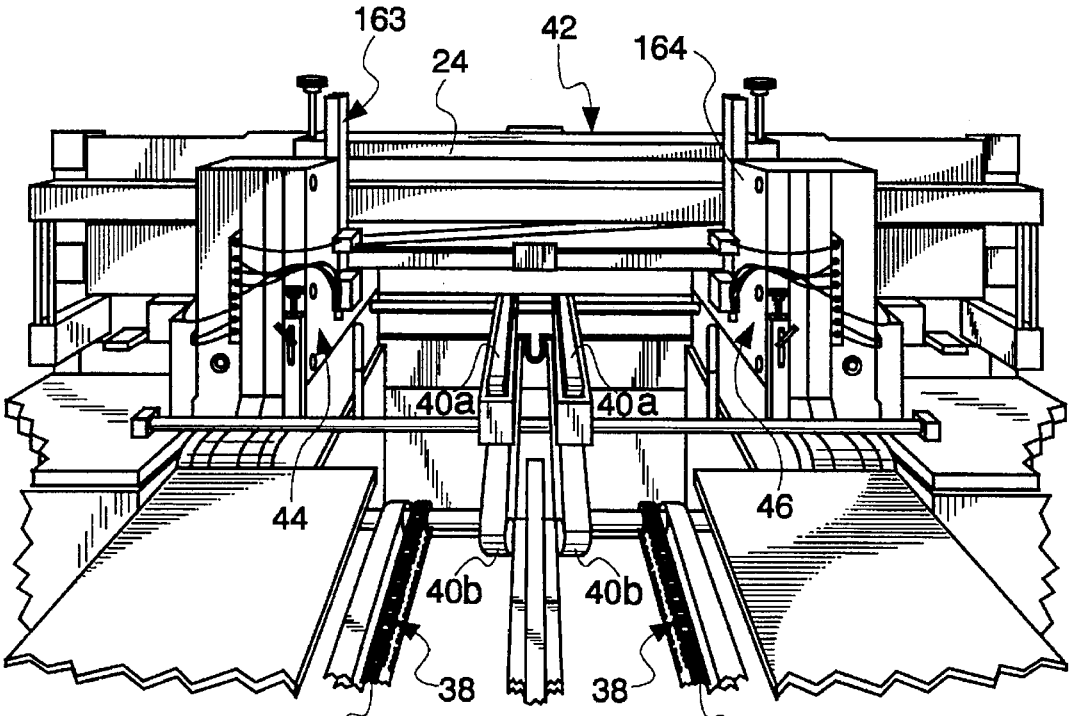
FIG. 24 is a perspective view of the infeed conveyors and cutting station of the trimmer apparatus.

As shown in the drawings for purposes of illustration, the bindery apparatus comprises a plurality of pocket feeders or pocket machines 12, 12*a* each of which has a rotating gripping mechanism 14 which feeds folded signatures 16 from a pocket hopper 18 (FIG. 25) to a saddle 20. The signatures are dropped one on another from the respective pocket machines and thus, are collated as they are conveyed along a saddle 20 by means of a gathering conveyor 22 which preferably has lugs 22*a* to abut the trailing edges of the signatures which are being collated to make a book form 16 in FIG. 9. The book forms are transported to a transfer station 30 at which is located a transfer conveyor 30 which transfers the book forms from the gathering conveyor 22 to a second or double lug gathering chain 32, which carries the book forms through a stitcher station 34 at which stitches or staples 36 are stapled through a fold line 38 for the book forms. The now-stitched book forms leave the saddle 20 after stitching and are conveyed at right angles by a trimmer, infeed conveyor 38 (FIG. 25), at which a pair of upper and lower feed belts 40*a* and 40*b*, move the book forms into a trimmer 42 where they are first stopped and trimmed by head and foot knives 44 and 46 (FIG. 24). After cutting the head and foot of the book forms, the book forms then are conveyed forwardly to stops 50 (FIG. 1A) while a face cut knife 52 cuts the rear trailing edges of the book forms.

While only several pocket feeders 12, 12*a* have been shown, it is to be understood that there may be a large number of pocket feeders, for example, 18 such pocket feeders which drop 18 folded signatures, one on top of another, to form a fairly large and thick extensive book form. The thickness of the book form may also be varied because some of the signatures may include several folded sheets so that the number of sheets or signatures in the book form may be larger than 18 sheets in this instance. Heretofore, when setting up a large number of pocket machines the operator would order a skid load of the respective signatures for each one of the pocket machines and have them delivered. Sometimes delivery of such a large number of different signatures to 18 pockets could take as long as an hour to one and one-half hours during which time the signature machines would not be made ready, and no other substantial make-ready operations would have been performed.

Figure 26:
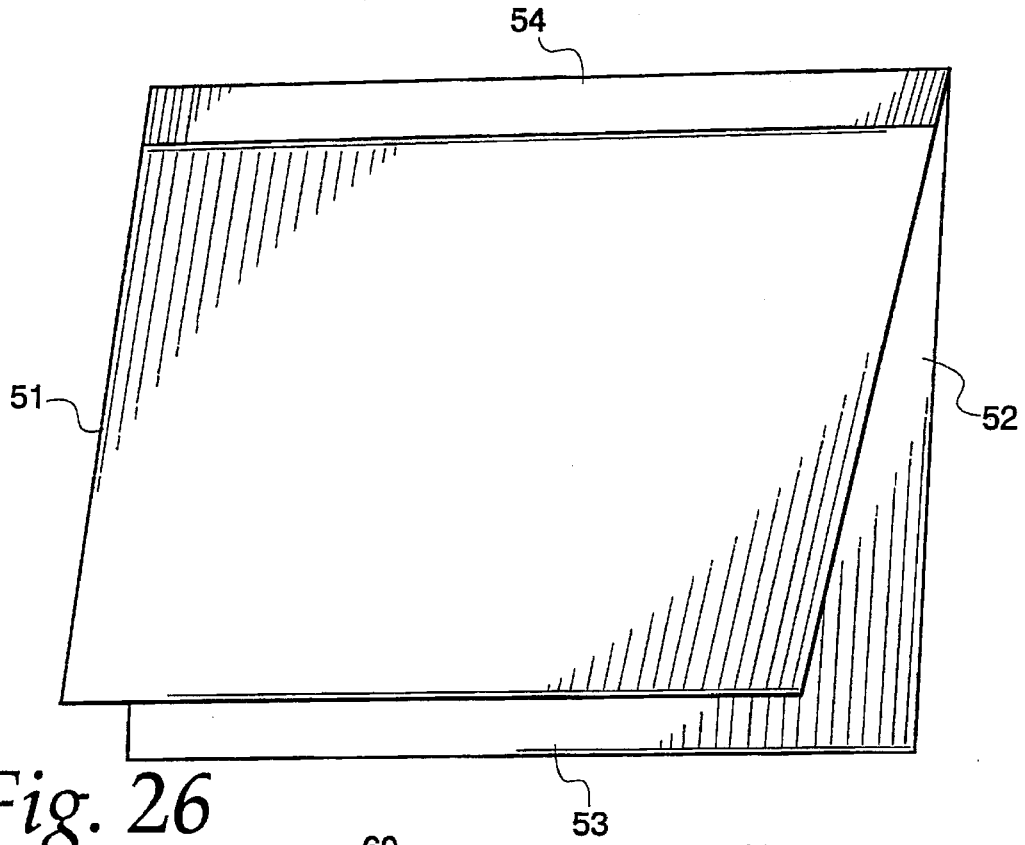
FIG. 26 is a view of a folded signature.

In accordance with the present invention, the make-ready process proceeds whether or not the skid loads of signatures are present. The operator will take a sample signature for each of the pockets and measure it. For example, as best seen in FIG. 26, the length measurement may be from a head side 51 to a foot side 52 which for the example given are described herein in detail is 10". The height dimension is from the face 53 to the fold or backbone 54 which in this instance could be 8". The signature includes laps or edges which are going to be severed off to leave the book form at its final size after being trimmed by the trimmer.

Figure 3:
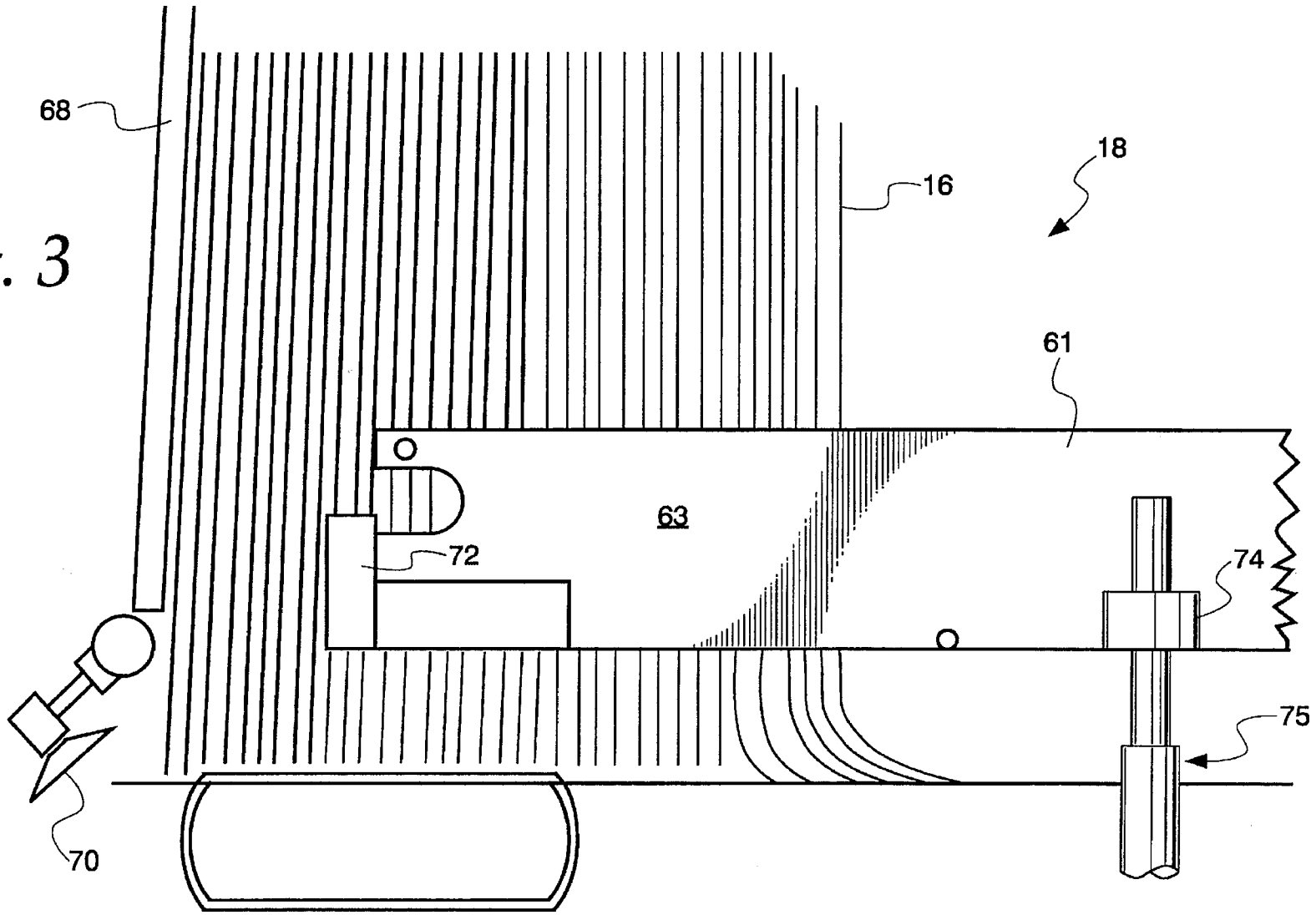
FIG. 3 is a side elevational view of a signature guide pocket having a retractable indicator.

In the conventional set-up of the pocket machine 12, the operator waited until delivery of actual signatures to the respective signature pockets. Often if there were 18 pockets, it could take as much as one hour to one and one-half hours for the skids to be delivered with the signatures for each of the 18 pockets. Usually, the operator did not set up pockets ahead of time without having an actual signature to be used to set up the pocket. In setting up the pocket with the signature in the conventional machines, the operator folds the signature in half between the head 51 and foot 52, sights this fold on the centerline 60 (FIG. 4B) of the machine hopper, and then adjusts the inner ends 63 of the signature guides, and then adjusts and sights the outer ends 64 of the signature guides 61 and 62 to define the particular amount of bow (FIG. 4B) that is desired for the signatures. If there is an improper amount of bow, the lower ends of the signatures 16 will not stand straight and will be inclined rearwardly (as seen at the righthand portion of the signatures 16 in FIG. 3) wherein there is an improper bow, and the signatures are bent downwardly. An improper bow in one of the 18 signature hoppers can result in an improper feed which will necessitate the stopping of the entire bindery apparatus 10 and the tweaking and the adjustment of the pocket machine to overcome this misalignment. Typically the operator would fold the signature in half and put the signature against the backplate and proceed to go ahead and move inner ends 63 (FIG. 4B) of the left and right side guides 61 and 62 to their respective positions to abut the respective sides of the signature being held by the operator with the signature fold line being at the centerline 60 of the pocket backplate 68 (FIG. 3).

Figure 6:
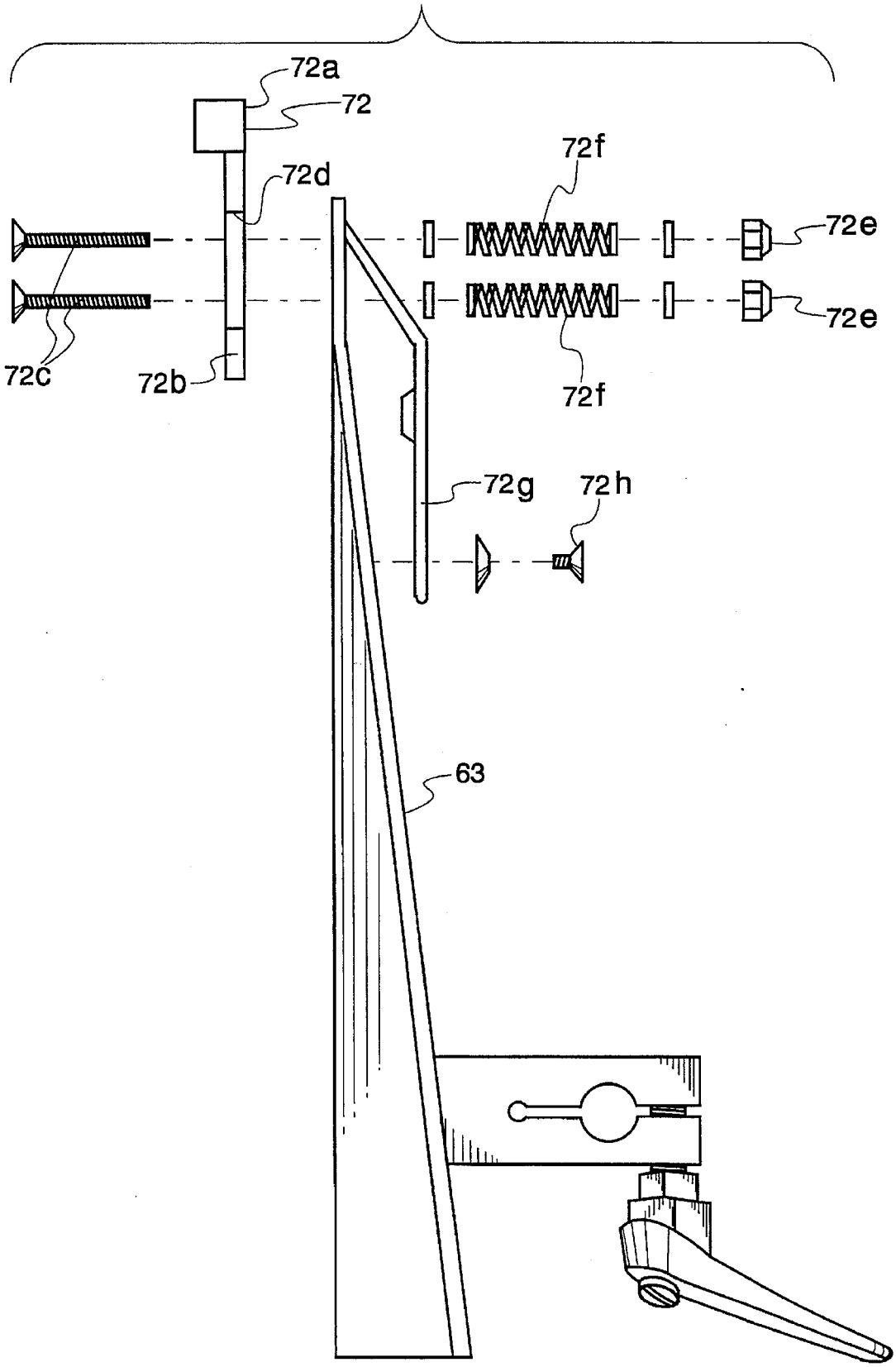
FIG. 6 illustrates the connection of a retractable indicator attached to the front guide.
Figure 7:
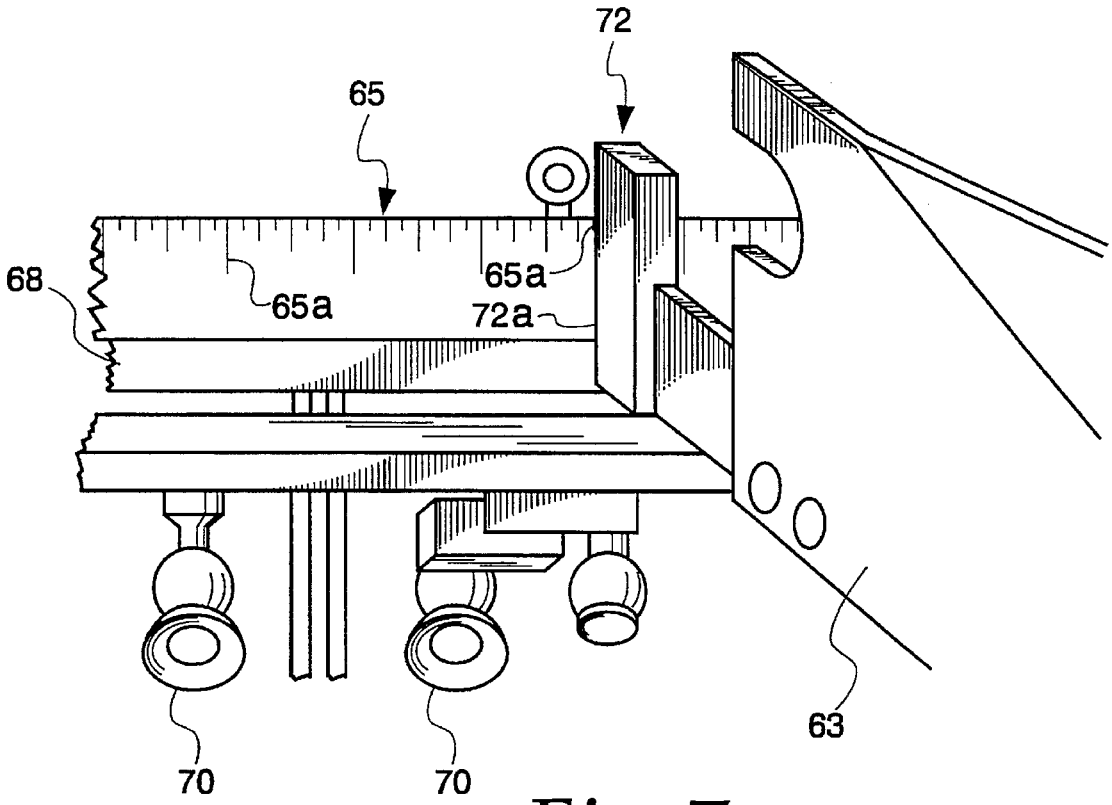
FIG. 7 is an illustration of a retractable indicator and the back plate scale.

In accordance with the present invention, the operator may use historical data collected from a previously-run job and recorded on a job card 67 (FIG. 12) as to what settings the inner ends 63 (FIG. 4B) are to be set when using the scale 65 (FIG. 7) and the signature guide indicators 72 (FIG. 2) which can be moved forwardly from a retracted position to an indicating position shown in FIG. 7 wherein the indicators 72 have a forward edge 72*a* (FIG. 6) positioned adjacent to and indicating an indicia 65*a* (FIG. 7) on the scale 65.

In accordance with the present invention, if there is no job card from a previous running of the same job, the length of the signature may be measured without the signature having been present at the machine pocket hopper. Also, the bindery apparatus 10 can be adjusted while it is running another job.

Figure 4:
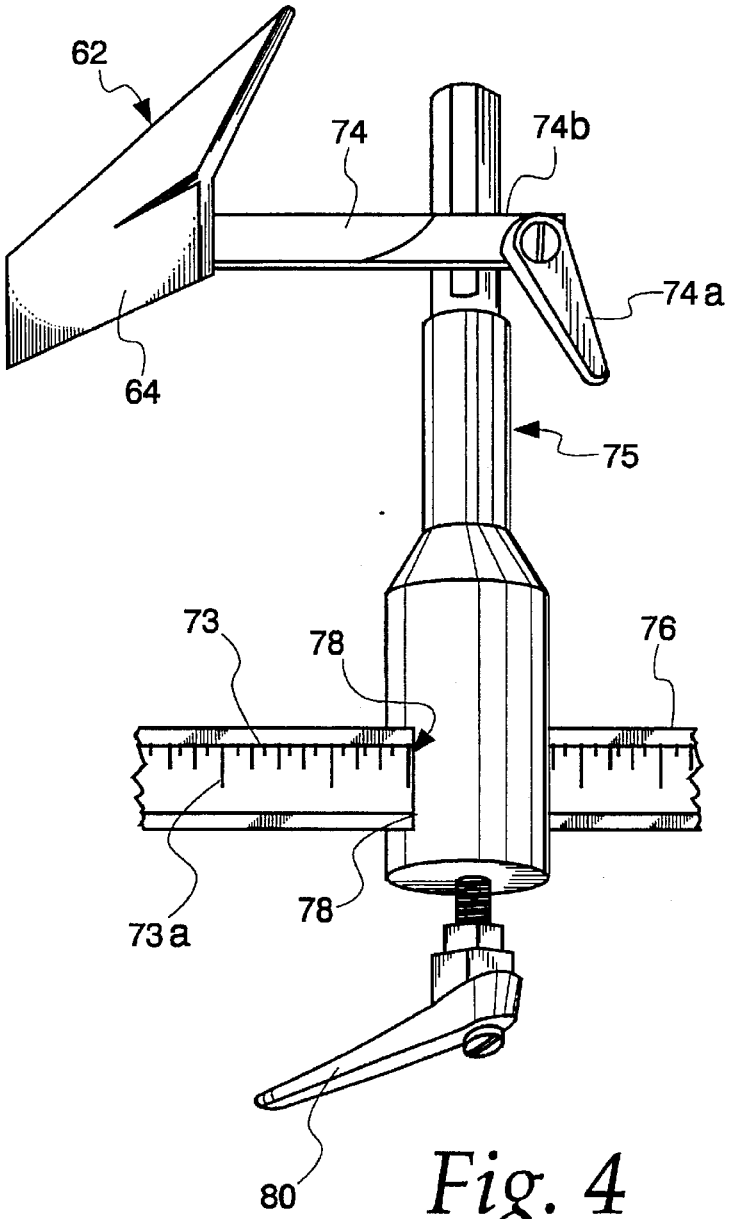
FIG. 4 is an elevational view of pocket bar scale and a pocket post scale, and a signature guide mounted thereon.
Figure 4A:
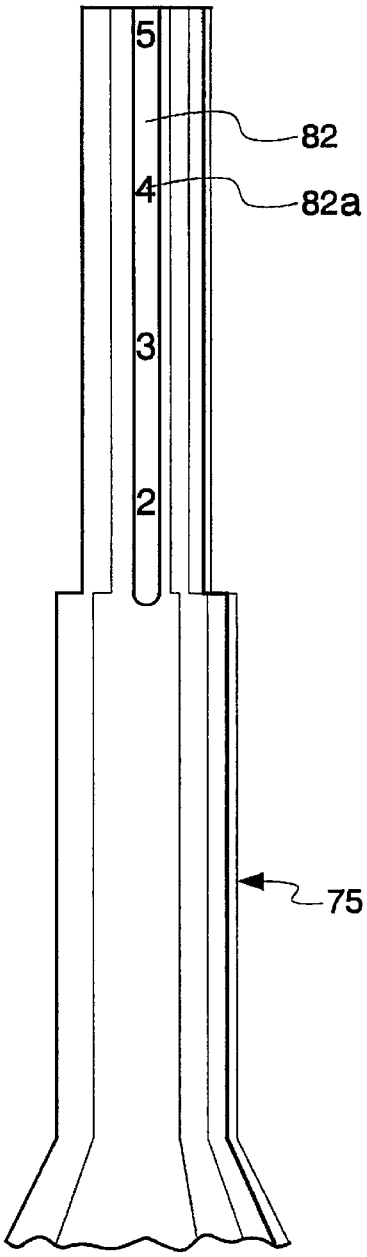
FIG. 4A is a view of the pocket post with the scale thereon.
Figure 4B:
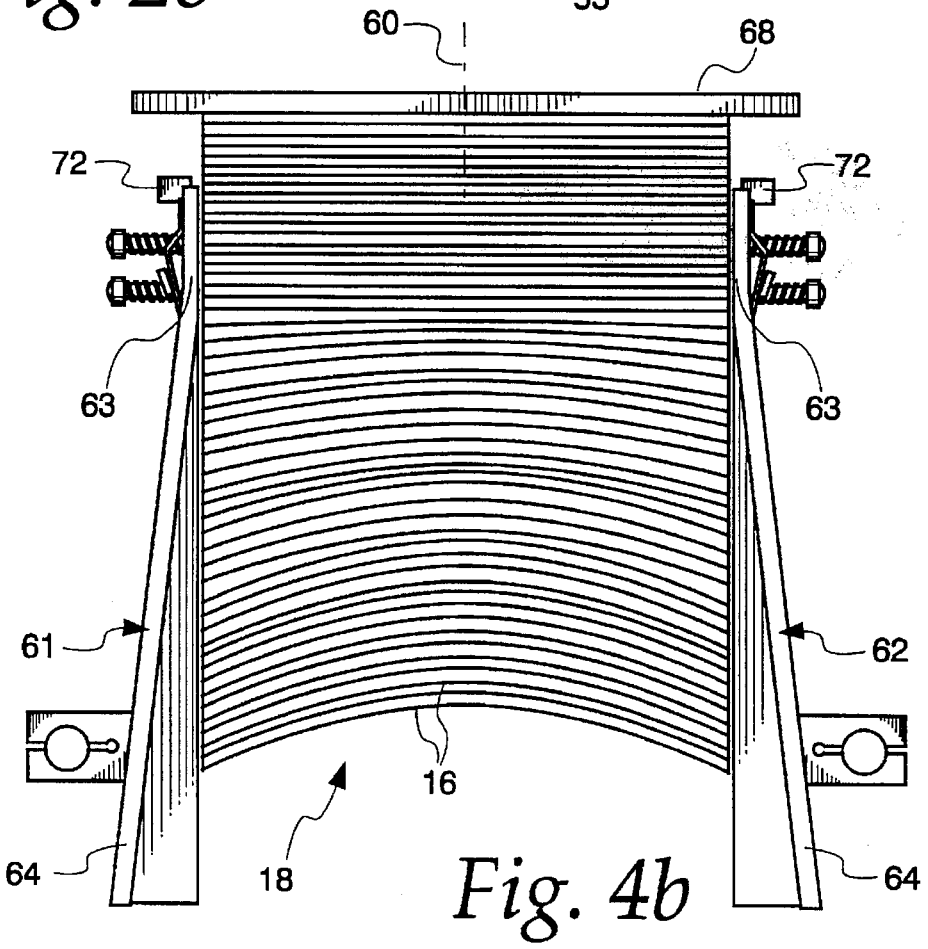
FIG. 4B is a plan view showing a hopper, signatures and signature guides.
Figure 8:
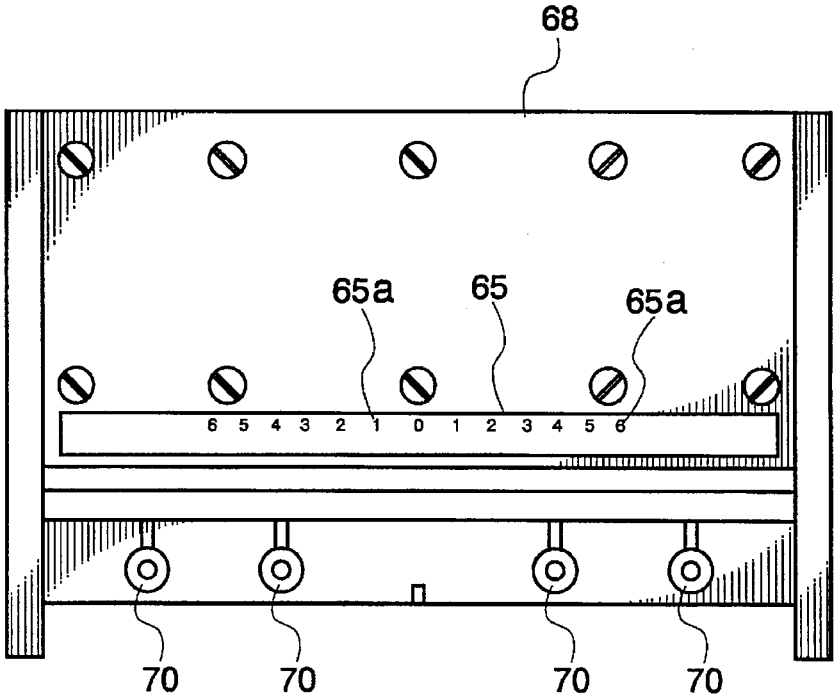
FIG. 8 is a front elevational view showing the pocket backplate scale and suckers showing for removing a signature from the pocket.

That is, if the individual pocket machine 12 (FIG. 1) is idle, the operator may position the side guides 61 and 62 (FIG. 4B) until the indicator edges 72*a* each is aligned with an indicia related to the specific length of the signature. It is preferred that if there is a 10" length for the signature, for example, that an indicia 10 be located by each side guide indicator 72 (FIG. 7). To facilitate such an easy manner of operation, the indicia 65*a* on the scale are actually one-half to scale. For example, an indicia "1" on the scale is actually ½" from the zero (FIG. 8) on the scale 65 rather than 1" from the "0" indicia. Thus, for example, as view in FIG. 8, the distance between "1" on the right and "1" on the left indicia 65*a* is exactly 1" rather than 2". Also, the scales read in opposite directions with the righthand portion of the scale 65 having indicia ascending from left to right; whereas, indicia on the lefthand portion of the scale ascend in the opposite order from right to left. This, of course, allows the operator to merely measure, for example, a 10" width dimension for the signature and adjust both the side guides to the number 10 indicia without having to perform any mathematics or any calculations with respect to the centerline 60 (FIG. 4B). The preferred scale 65 (FIG. 8) is merely a small, thin strip which has been secured to the backplate 68 as by an adhesive or fasteners.

The retractable side guides 72 are slidably mounted on the guides 61 and 62 (FIG. 2) to be moved from a retracted position shown in FIG. 3 to the extended position shown in FIG. 7 wherein forward edges 72*a* are adjacent the scale 65 for setting the front ends 63 of the signature guides. Herein the slidable movement of the indicator 72 between its retracted and extended positions is accomplished by having the signature guide formed with a slidable plate 72*b* (FIG. 6) having a forward indicating end thereon with the slidable plate being frictionally held against an outer side of the side guide by a pair of screws 72*c* which are inserted through an elongated slot 72*d* in the plate 72*b*. The screws do not tightly bind the plate to the side of the signature guide, but are frictionally held or biased there against because the screws 72*c* extend through a pair of washers and springs 72*f* to lock nuts 72*e*. The screws are threaded into the lock nuts to compress the springs against an angled backing plate 72*g* which is secured by a fastener 72*h* to the signature guide. This frictional retention by the screws 72*c* and the springs 72*f* allows the operator to grasp and push or pull the indicator 72 between the indicating position against closely adjacent the scale 65 or to the retracted position, as shown in FIG. 3.

Figure 2:
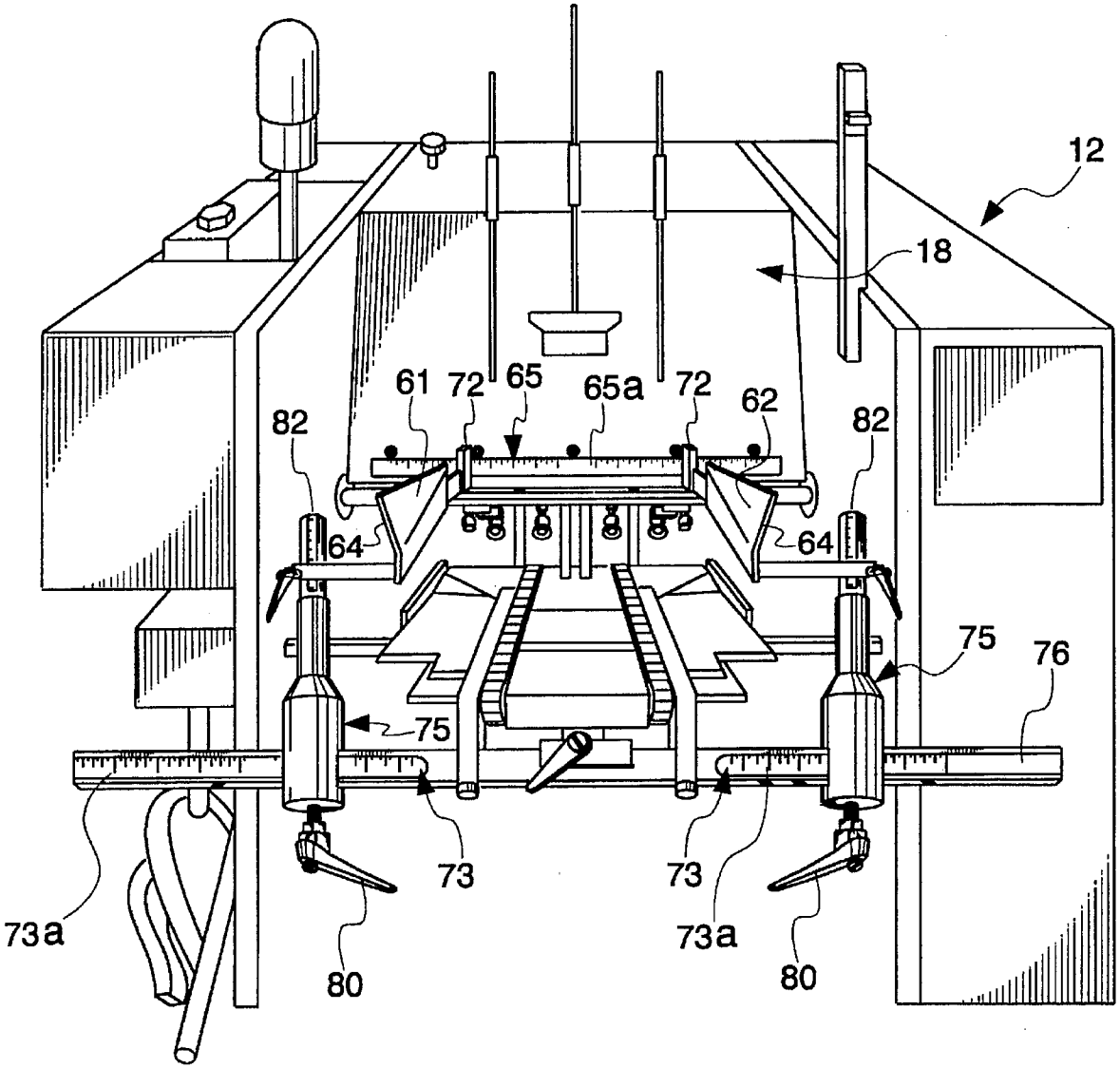
FIG. 2 is a perspective view of a hopper of a signature pocket machine.

Heretofore, each of the operators use different systems for sighting in the bows 64 for the signature 16 (FIG. 4B) to cause the signatures to stand straight in the pocket hopper 18 (FIG. 2). A bow is usually achieved by the operator's experience for a particular size of sheet or a particular thickness of signature. The bow is important to the proper feed of the sheets by the signature suckers 70 (FIGS. 4B and 7). An improper bow of a signature or a misalignment of a signature relative to the centerline of the pocket may result in a feeding jam, or may result in feeding of several signatures correctly, and then suddenly in feeding a signature incorrectly. A misfeed usually requires the bindery apparatus 10 to be shut down, and then a tweaking operation to be done to provide a correction for the misalignment. However, the misalignments when they are intermittent or are spaced apart with correct signature feeds are difficult to locate and correct. Thus, misalignments in the hopper should be eliminated in the first instance, if possible. To this end, the bow of signatures in the pocket hopper is preferably achieved automatically with the use of rear pocket scales 73 (FIGS. 4 and 5) which allow the bow to be automatically set when the outer portions 64 (FIG. 2) of the side guides 61 and 62 are set at the distance measured for the signature length which is the same dimension used for the signatures with respect to the backplate scale 65. Herein, this is achieved by having the pocket's backplate scale 65 (FIG. 2) set so that there is about a 3/4" difference between them for the same readings that are on the pocket bar scale 73 and on the scale 65 at the backplate 68 (FIG. 3). For example, if the signature is 10" in length and the numbers 10 have been indicated by the retractable side guide indicators 72 (FIG. 2) on the scale 65, the same 10" may be used at the pocket bar scale 73, but the actual distance between the rear ends 64 and the side guide guides is 9¼"—the ¾" shortness being used to cause the bow of the signatures. Thus, in the preferred embodiment of the invention the operator does not have to do any calculations or use any judgment to obtain a bow. For the machines shown herein, the 3/4" bow works for most signatures being used.

Figure 5:
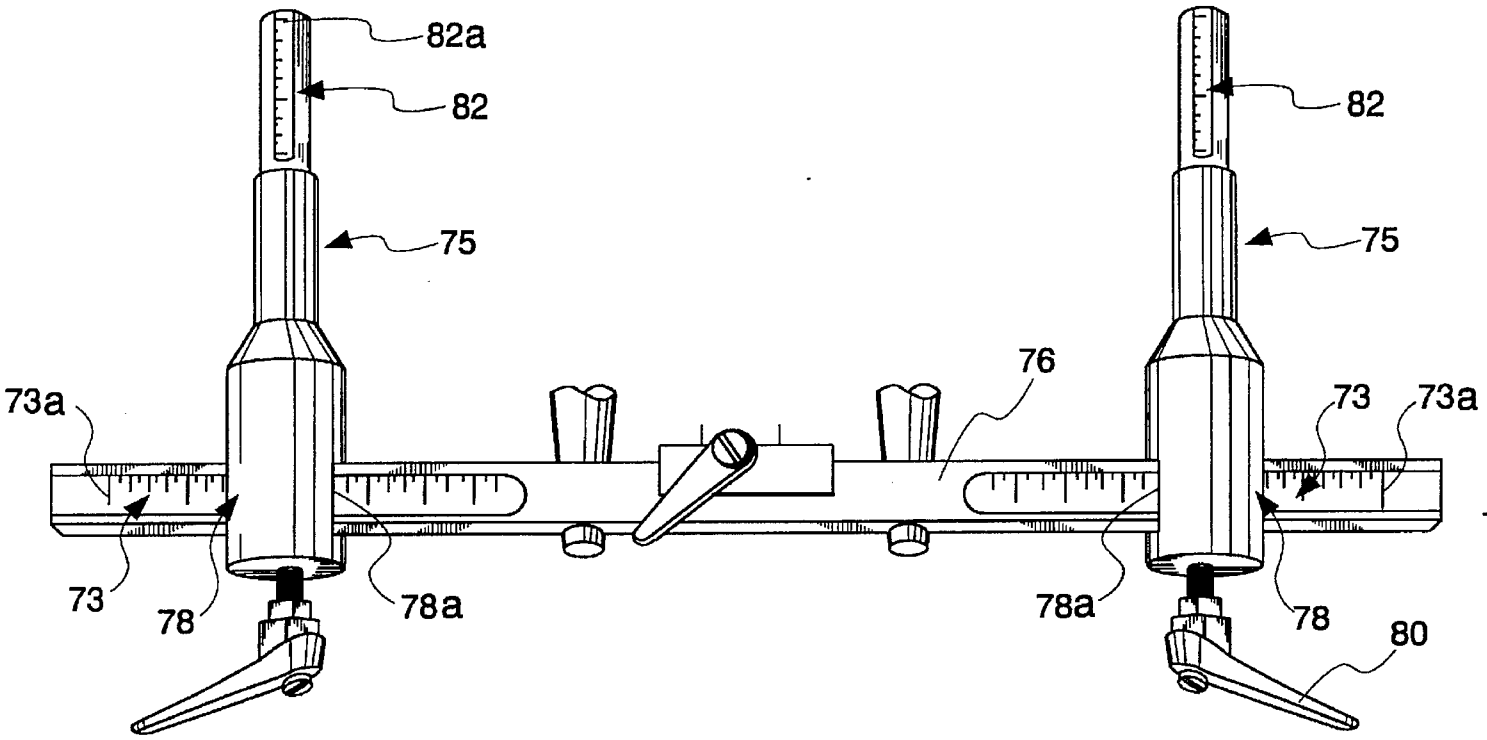
FIG. 5 is an elevational view showing a pair of pocket posts and a pair of pocket scales for the posts.
Figure 5B:
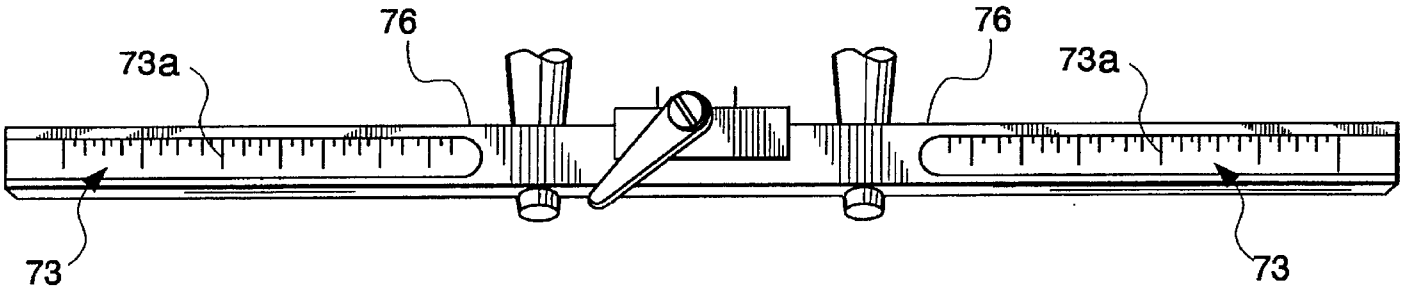
FIG. 5B is a figure showing the scales for the pocket bar location.

In the Muller pocket machine being described herein, the rear or outer ends 64 of the signature guides 61 and 62 are supported in cantilevered fashion by a top-supporting arm 74 (FIG. 4) which is mounted to and carried by a vertical pocket post 75 which is slidably mounted to slide horizontally on a bar 76 toward or away from the opposite signature guide. The pocket bar 76 extends horizontally as best seen in FIGS. 4 and 5. The pocket posts are slidable along the bar 76 by having slots 78 in their lower ends which are receiving therein the bar. A lower screw handle clamp 80 is provided and is turned to tighten and lock the pocket posts at the desired position along the pocket bar.

Their respective left and right pocket bar scales 73 are separated, as shown in FIG. 5, and they are similar to the backplate scale 65 in that they are to about half scale, except for the ¾" difference, and in that they have ascending numbers on the righthand portion from left to right and in the opposite for the lefthand portion with the numbers ascending right to left. Thus, the operator, for example, for a 10" length signature, will slide the right pocket post in FIG. 5 until an edge 78*a* of the slot 78 on the pocket post is at the proper indicia, viz. 10, and likewise will move the left pocket post until the edge 78*a* on the post 75 is also at the indicia 10. Thus, the operator need not have to do any mathematics nor do any sight adjustments to achieve a bow of 3/4". The actual distance in this example between the left edge 78*a* and the right edge 78*a* is 9¼". The preferred scales 73 for the pocket bar are again small, linear strips with indicia 73*a* thereon; and the strips are graduated in ⅛" increments which in point of fact, is actually about 1/16" because of the fact that there are left and a righthand scale strips, as shown in FIG. 5. The scales 65 and 73 (FIG. 2) were added and not present on the conventional pocket machine.

On the conventional pocket machine, the height of the signature guides 61 and 62 is generally determined by folding the signature vertically in half and then adjusting the signature guide so that it is located at one-half of the height of the signature. In the present invention, one may fold the signature in half and measure the one half with a tape measure, and use this measurement to set the side guides vertically on the pocket post. If one has the historical height for the side guides on the job card 67 (FIG. 12), one can use this height data to set the side guides 61 and 62 vertically. To aid in the proper vertical positioning, there has been provided a pocket post scale 82 which is attached along the vertical, upper end of each pocket post 75, as shown in FIGS. 4A and 5, with indicia 82*a* on the scale. In this instance, the scale 82 is to actual size—that is, 1" on the scale 82 and shown by the indicia 1 is actually a 1" measurement. The signatures guides are moved vertically along the pocket posts 75 in the usual manner and there is a clamping handle 74*a* which is attached to and cooperates with a top-supporting arm 74 to lock the signature guide in the adjusted vertical height position. Upper edge 74*b* of the cantilever supporting arm 74 is used as an indicator for aligning with the appropriate indicia 82*a* on the pocket scale 82 to set the signature guide at exactly one-half of the height of the signature. Thus, it will be seen that the spacing between the inner and ends of the signature guides, as well as the height of the signature guides, may be set to size without actually having to use a sample of the signature in the pocket itself.

The illustrated pocket post scale 82 is a thin strip which was added to the post. Preferably, the post was formed, as best seen in FIG. 4A, with the ¼" wide groove which is ⅛" deep and the scale 82 was set inside the groove. The pocket post scale in this example is about 3½" in vertical height, and displays a lower indicia of 2⅜" at the bottom through the indicia of 5⅞" at the top for this particular pocket machine. Manifestly, the scales could be considerably different for different machines.

The signatures 16 (FIG. 25) are fed from the pocket hopper 12 by the rotating gripper mechanism 14 to the gathering conveyor 22 which has a lug 22*a* which should be located immediately behind the trailing edge of the signature as it is deposited on the saddle 20. The signature has its opposite sheets spread over the triangular saddle 20 at the time of drop. The timing of the drop is one of the most arduous and time-consuming aspects of setting up of the conventional bindery line, particularly when one considers that there may be as many as 18 stations each with its own specialized drop. Of course, this timing for the drop varies with the size of the signature. Heretofore, an operator would jog the lug 22*a* of the single gathering chain conveyor 22 to a position beneath the pocket machine, and then rotate the gripper mechanism to cause a signature drop to see how close it landed to the leading edge of the lug 22. If the lug was too far advanced, the signature would drop on top of the lug. If the lug was not sufficiently advanced, there would be considerable space between the signature dropping onto the saddle 20 and the approaching lug. The operator used primarily his judgment in this particular timing operation.

Figure 14:
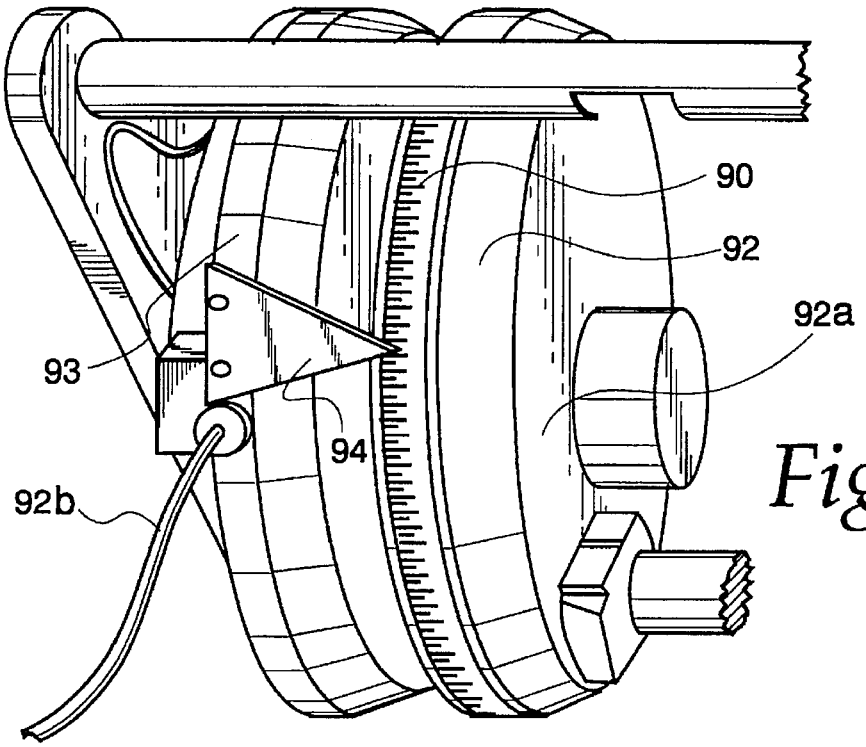
FIG. 14 is a perspective view of drop timing scale.
Figure 16:
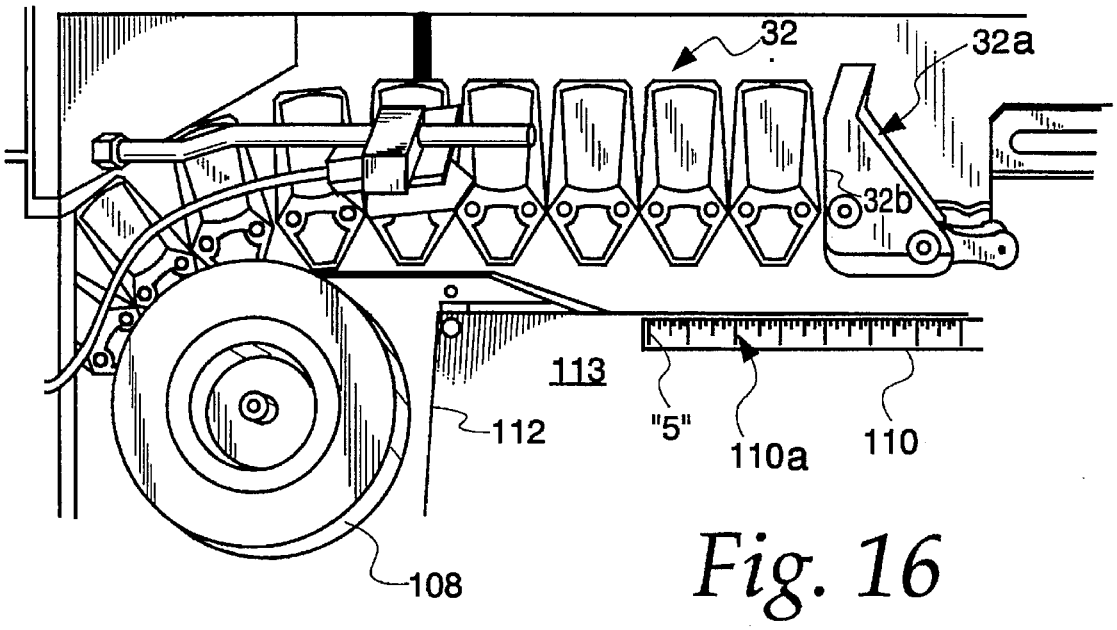
FIG. 16 is a view of the double chain conveyor scale.

In accordance with the present invention, the timing of the drop of the signature from the pocket hopper 18 to the gathering chain lug 22*a* is accomplished with the use of a scale 90 (FIG. 14) which is located on the upper gripper drum 92, as best seen in FIGS. 14 and 16. The gripper drum scale 90 rotates with the gripper drum 92, and a stationary scale indicator 94 is mounted to a stationary part 93 to cooperate with the scale on the gripper drum. Unlike the scales heretofore described in connection with the signature pocket, the scale 90 has no definite relationship to the measurable size of a signature. The scale is particularly useful when running the same job a second time. In such an event, the scale provides a reference to which the gripper drum is rotated to provide the same indicia as recorded opposite the indicator 94. Hence, the upper grippers should be timed to operate as they did the last time the job was run. If a new job is being run, the operator should use previous data obtained when dropping similar sizes of signatures in the past onto the saddle.

Figure 15:
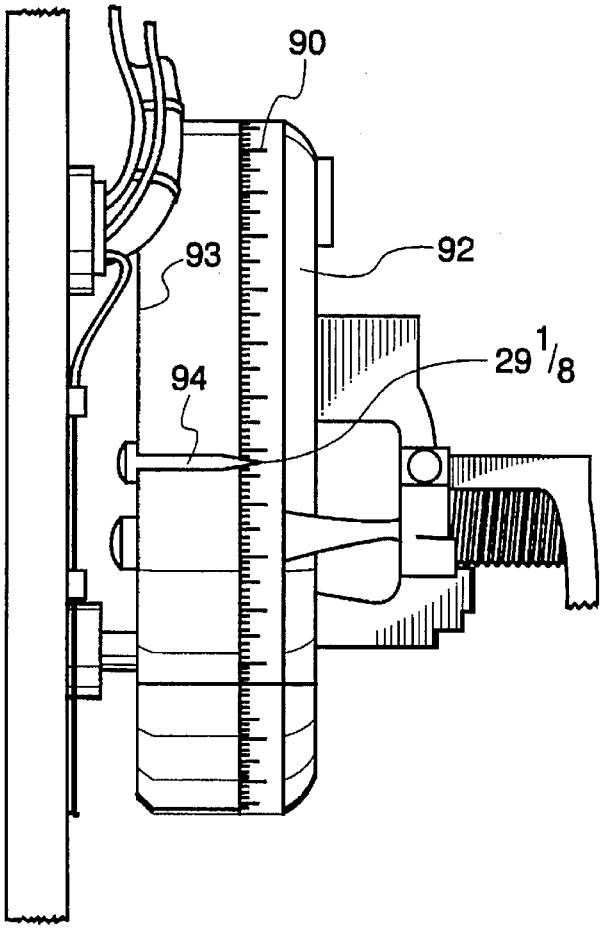
FIG. 15 is a side-elevational view of FIG. 14.

For example, if a signature measures 10" in length, and the operator had a number of previous job histories of indicia 29⅛ for signatures close to 10" in length, then gripper drum cam could be rotated to the 29⅛ indicia shown in FIG. 15 and used to approximate the drop. The particular gripper drum indicia are related to a reference point for the lug 22*a* (FIG. 1) on the single gathering chain when the bindery apparatus is locked out at reference position, viz., 100°. (FIG. 23) in this instance. The scale 90 (FIG. 14) is only useful because the lug 22*a* (FIG. 1) has been precisely positioned on the conveyor chain 22 at a reference position. This reference position is 100° on a timing scale 80 and an indicator 81 (FIG. 9) for the main line drive for the gathering chains, as will be described hereinafter. When the bindery apparatus is locked out at 100°, the lugs 22*a* (FIG. 1) are precisely set on the chain 22 at the measured length distance for the particular signature and hence, timing of the drop from a machine 12 can be replicated from one job to the next, as will be explained in greater detail.

After running a job, if the upper grippers had to be tweaked by turning the gripper cam 92 (FIG. 14) with the scale moving therewith to a new indicia, then this new indicia is recorded in place of the original indicia so that the next time the job is run at this particular signature pocket feeder 12 (FIG. 1), the upper gripper mechanism cam 92 (FIG. 14) can be set to the final adjusted tweaked indicia so that the previous tweaking may be eliminated. The adjustment using the scale 90 permits a timing on the drop to the single lug gathering chain without having to jog the machine as before. That is, heretofore each of the stations 12 had to be jogged for the set-up of the drop; and every time one of the 18 stations was being jogged, then all of their operators working on the machine had to take their hands off that particular machine they were working on. For example, if an operator was making ready the trimmer machine, the stitcher machine, or one of the conveyors, the operator had to quit his work so that he did not get hurt while a jogging of the entire bindery apparatus 10 was taking place. In the present invention with the machine stopped and everything locked at the reference point of 100°, the pockets may be timed to the conveyor 22 (FIG. 1) using the scale 90 (FIG. 14) and the indicator 94 without any jogging. Indeed, if one job is being run and a particular pocket machine 12 (FIG. 1) is not being used, it can be set to the particular timing using the scale 92 (FIG. 14) without having to jog the machine and it can be set up prior to the finish of the currently running job.

Figure 13:
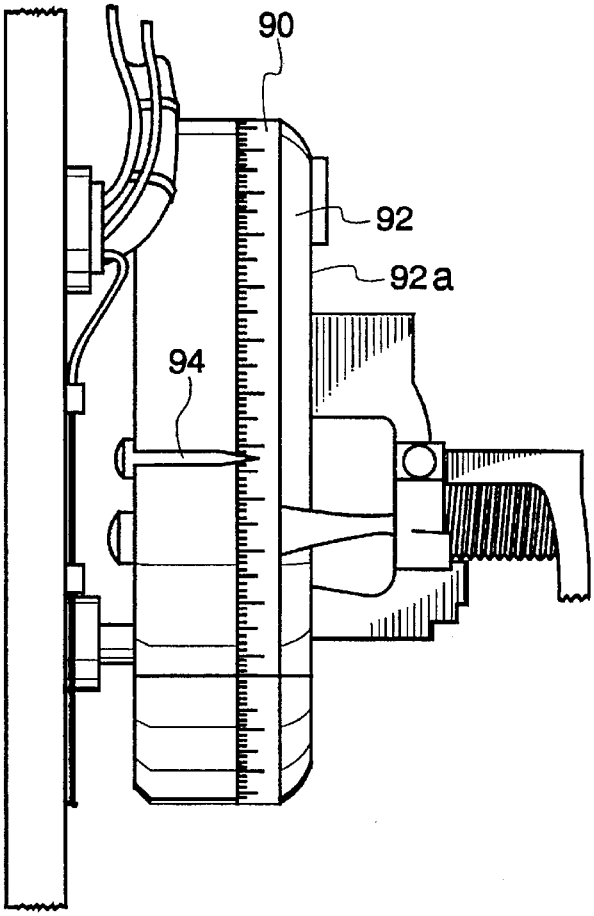
FIG. 13 is an elevational view showing the upper drum gripper scale for timing the pocket to the gathering chain.

In the particular Muller machine shown herein, there is a stop bar at which the upper gripper drums 95 (FIG. 11) move and grab the sheet from the suckers 70 (FIG. 3) and rotate it up to hit the stop; and then the lower gripper drum 96 (FIG. 11) grabs the lower edge of the sheet when it is hitting the stop and pulls it downwardly. The Muller machine is provided with a semi-circular stop bar scale 91 that is stationary, and a movable indicator 91*a* is movable with the stop bar and points to a location on the scale 91. There is also a brush bar scale 93 and an indicator for setting the brush bar which brush the laps, as is well known. The preferred scale 90 is merely a thin strip which is secured by a fastener, such as an adhesive to the circular, peripheral surface of the cam 92 (FIG. 13). While the location of the scale 90 can be placed on the cam at various rotated positions to determine where "0" on the scale 90 is located, it is preferred to locate the "0" indicia 90*a* opposite a cam bolt 92*a*, as shown in FIG. 14, and to locate the indicator 94 at a distance of ½" from the center oil line 92*b* to the center of the bottom hole, as shown in FIG. 14 for a 279 pocket machine. For 316 and 342 pocket machines, the "0" and indicator 94 (FIG. 15) may be attached at slightly different locations.

Figure 1:
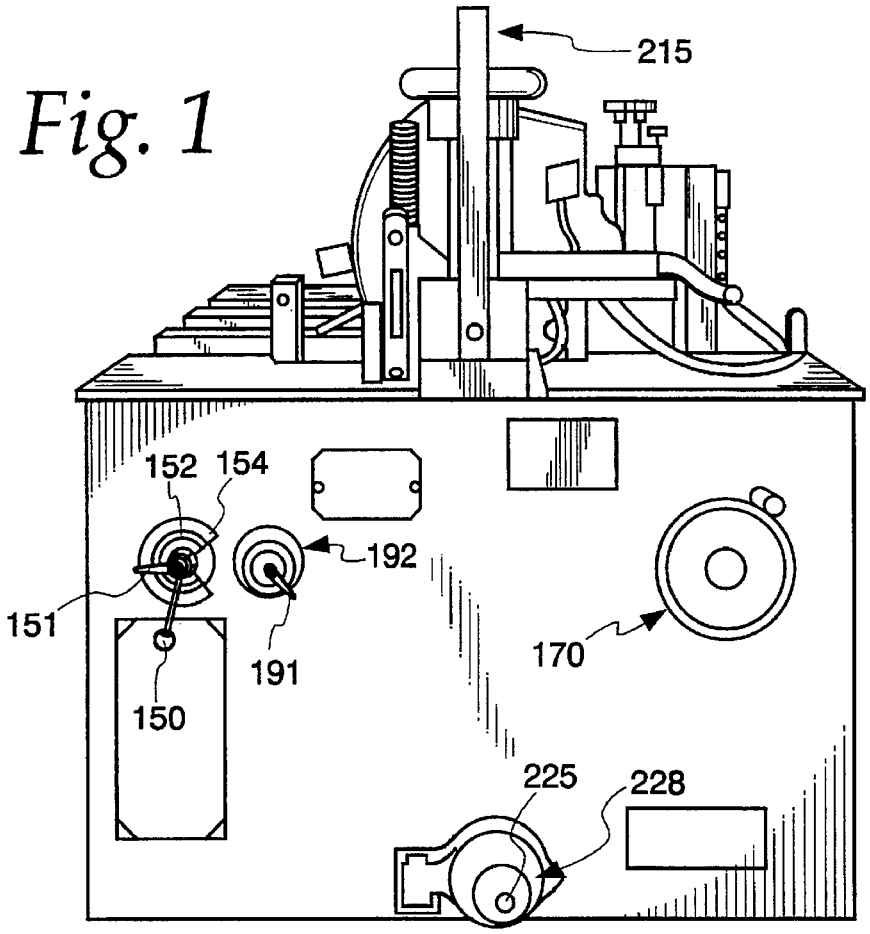
FIG. 1 is an isometric view of a trimmer apparatus constructed in accordance with the preferred embodiment of the invention.
Figure 1A:
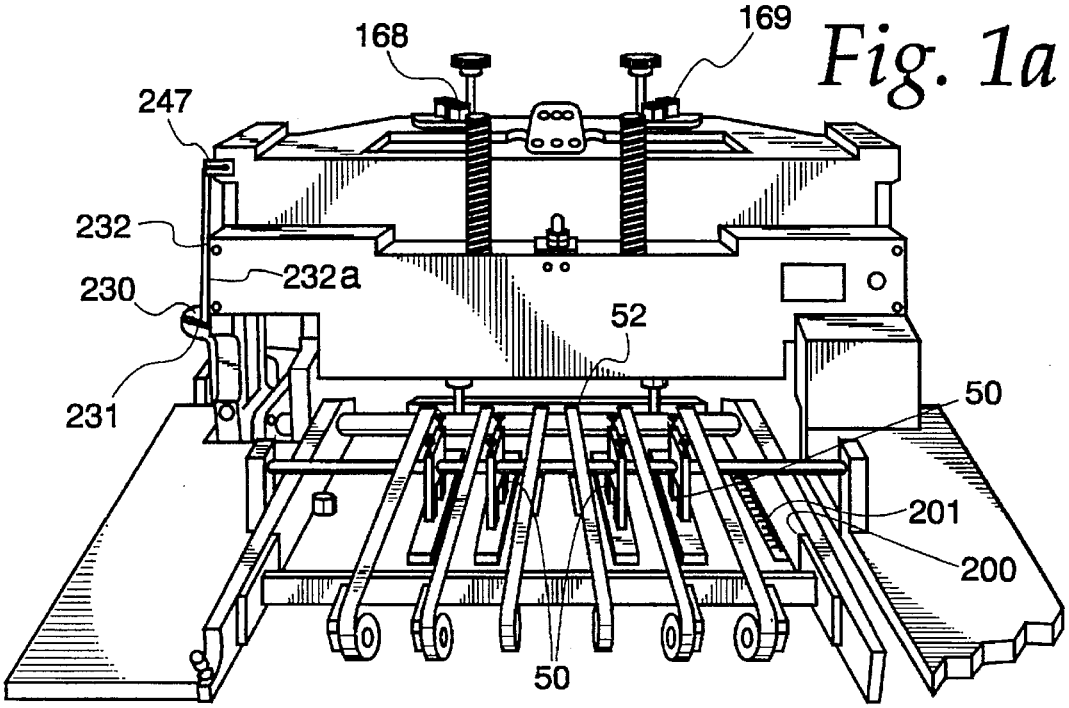
FIG. 1A is a side elevational view of the trimmer apparatus shown in FIG. 1.
Figure 11:
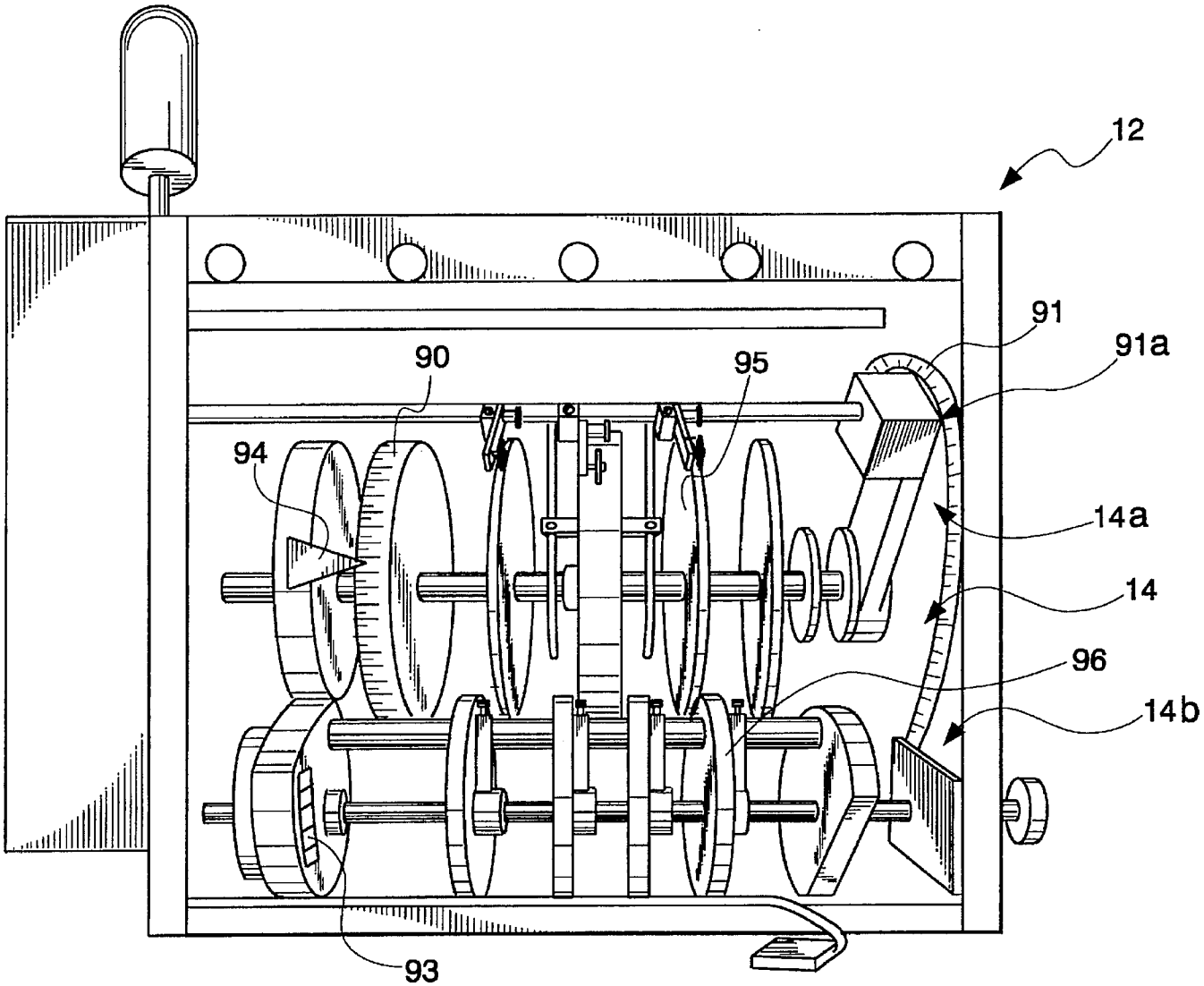
FIG. 11 is a view taken from the operator's viewpoint of the upper and lower gripper drums and upper gripper drum scale used.

The upper gripper drum 95, as best seen in FIG. 11, is part of an upper gripper drum mechanism 14*a* that has one or two grippers that grip the signature removed from the signature hopper by the suction gripper 70 (FIG. 3). As is well known, the upper gripper drum mechanism 14*a* is connected to and timed with the lower gripper drum mechanism 14*b*; and this lower gripper drum mechanism is adjusted when one shifts the upper gripper drum mechanism so that the timing of one also times the other at the same time. Using a scale 92 (FIG. 15), as above-described, at each of the pocket signature stations allows timing of their respective upper and lower gripper drums for their particular drop to the conveyor chain lug 22 (FIG. 1). Because the lug 22*a* is traveling in the advancing direction and because each signature feeder is at a different position relative to the saddle, each subsequent signature feeder is separately timed to drop its signatures to the saddle.

The signatures, after they are dropped onto the saddle 20, are conveyed first by the single gathering conveyor 22 to the transfer station 30 and its transfer conveyor 30 at which one of three lugs 30*a* on the transfer conveyor 30 picks up a book form from the single lug chain conveyor 22 and conveys this book form to the double lug conveyor 32 (FIG. 16) which has double lugs 32*a* thereon. The double lugs 32*a* convey the book form through the stitcher station 34 (FIG. 25) where it is stitched and then delivers it to the trimmer infeed conveyor 38 (FIG. 24) which carries the book form now stitched directly into the trimmer machine for trimming the book form. The double gathering chain 32 (FIG. 16) must be precisely timed to delivery the booklet form 26 (FIG. 9) into the center of the infeed conveyor 38 (FIG. 24) or a malfunction of the trimmer may occur, and a jam up in the trimmer which will shut down the entire bindery apparatus.

Figure 9:
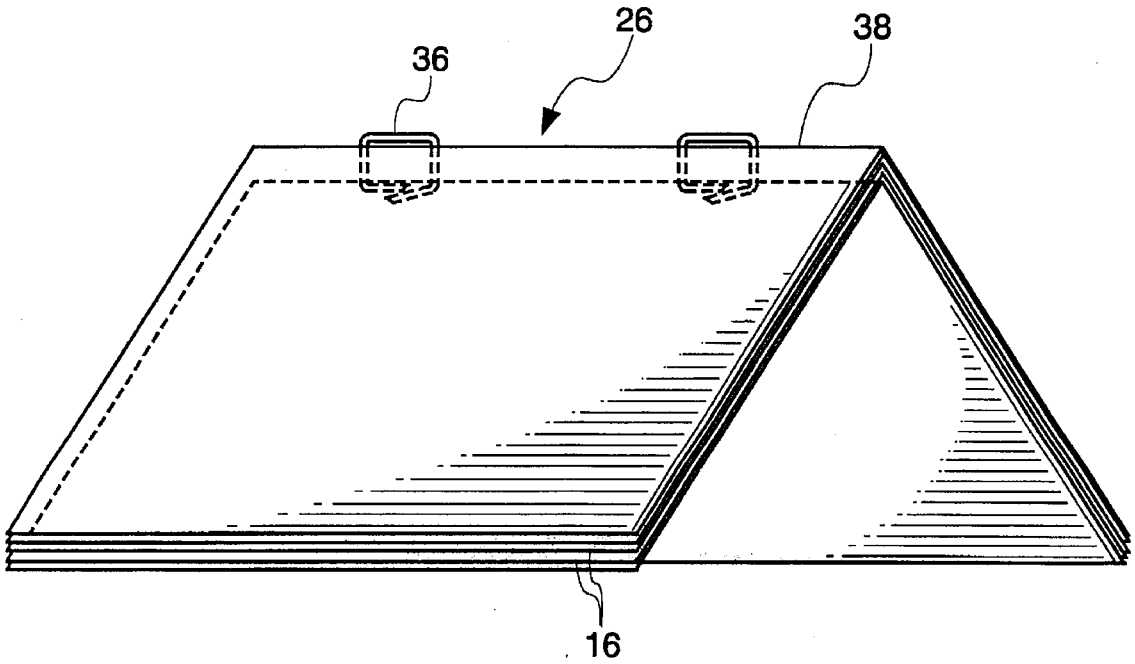
FIG. 9 is a perspective view of a book form.
Figure 23:
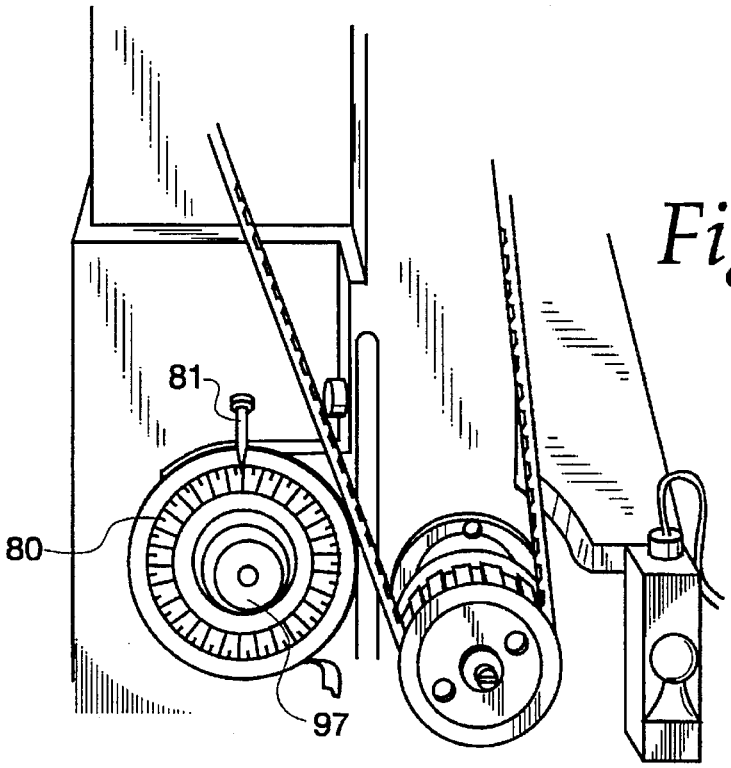
FIG. 23 shows a main line scale used for locking out the machine.

The present invention provides a quick and easy way of setting up of the respective conveyors without having to jog or run the machine as heretofore was the practice. Because the last saddle conveyor 32 (FIG. 16) must be timed directly to the trimmer infeed conveyor 38 (FIG. 24) which conveys the stitched book forms off to the trimmer, the conveyor 32 (FIG. 16) is first adjusted to its position with the main line drive 97 (FIG. 23) set at a reference point, which in this instance, is 100°. The main line drive 97 is locked out, that is, stopped at a reference point, as shown by a main line indicator 81 and a main line rotary, indicator scale 80 (FIGS. 9 and 23). The entire make-ready or set-up is done with the bindery apparatus stopped and locked at the reference position.

Heretofore, the operator had to put a signature on the double gathering chain 32 (FIG. 16) and approximate the amount that the double gathering chain had to be adjusted by rotating a double gathering chain adjustment wheel 108 (FIG. 16) and then having adjusted that, the operator placed a signature onto the transfer station and approximated the amount that the transfer station had to be adjusted by using a similar hand adjustment wheel for the transfer conveyor 30 (FIG. 1). After the chains had been sighted and adjusted, the conveyors were jogged and tweaked.

In accordance with the present invention, the double gathering chain conveyor 32 (FIG. 16) is at its position where it is located from the last run job that was run, and this position is at the 100° line lock out reference positions of FIGS. 9 and 23. There is provided a timing scale 110 (FIG. 22) (which is a one-half scale where a gradation of "1" equals a distance 0.50 inch). The timing scale 110 is used to set the lug 32*a* to the new length for the new signature that is to be run. To set up other machines, a scale should be brought to the saddle and positioned on the saddle where the last signature was run with the scale indicia located at the edge of the double lug indicating the length from head to foot for the last run signature. Then, the new scale will be fastened to the saddle. Hence, movement of the double lug to a new indicia along this scale will result in the lug being downstream for smaller signatures or upper stream for larger signatures from the lug position when the scale is first secured to the saddle. All of the gathering conveyor scales may be located in the same machines.

Figure 22:
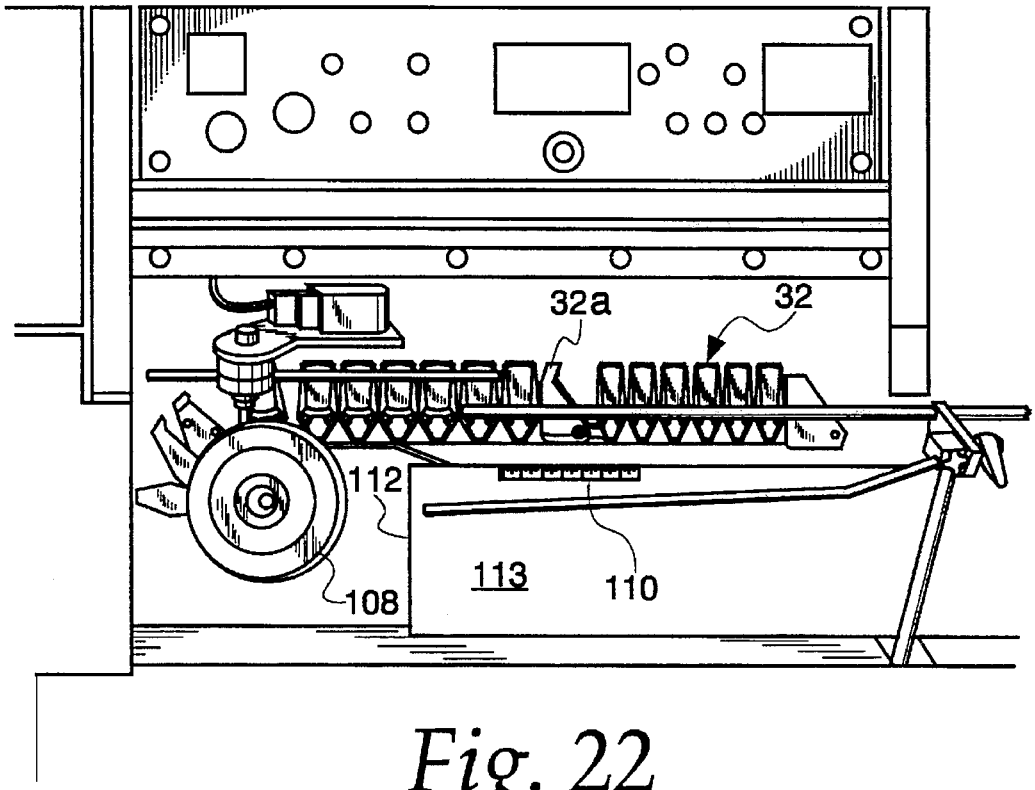
FIG. 22 illustrates the 90° double gathering chain scale.

With the double conveyor 32 disengaged from the main line drive, the hand wheel 108 is turned to move the lug 32*a* to the half length measurement on the scale 110. This is usually accomplished by taking a signature edge and abutting it against a leading edge 32*b* (FIG. 16) of the double gathering chain lug 32*a*, and advancing the lug until the signature edge is aligned with the proper indicia 110*a* on the scale 110. Thus, in the example being used herein if the lug 32*a* is to be used with a 10" long signature, then the lug 32*a* would have its leading edge 32*a* opposite the indicia 110*a* which is the numeral "10" on the double gathering chain scale 110, as seen in FIGS. 16 and 22. Thus, it will be seen that the signature measurement is used to set the lug 32*a* (FIG. 16) on the conveyor 32. If these signatures had measured 10½" long, then the leading lug edge 32*b* would have been set to 10 ½" on the scale 110 rather than to 10" as above-described.

Figure 19:
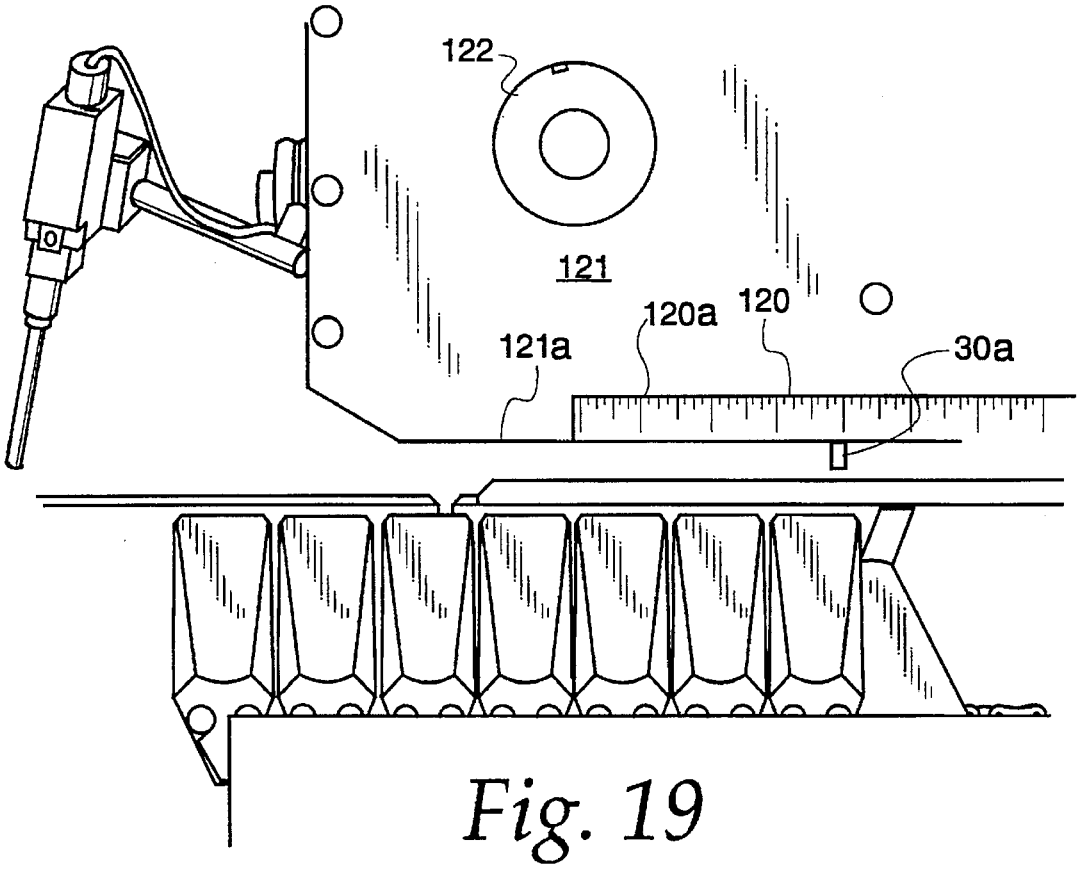
FIG. 19 is an enlarged view of the transfer station scale.
Figure 20:
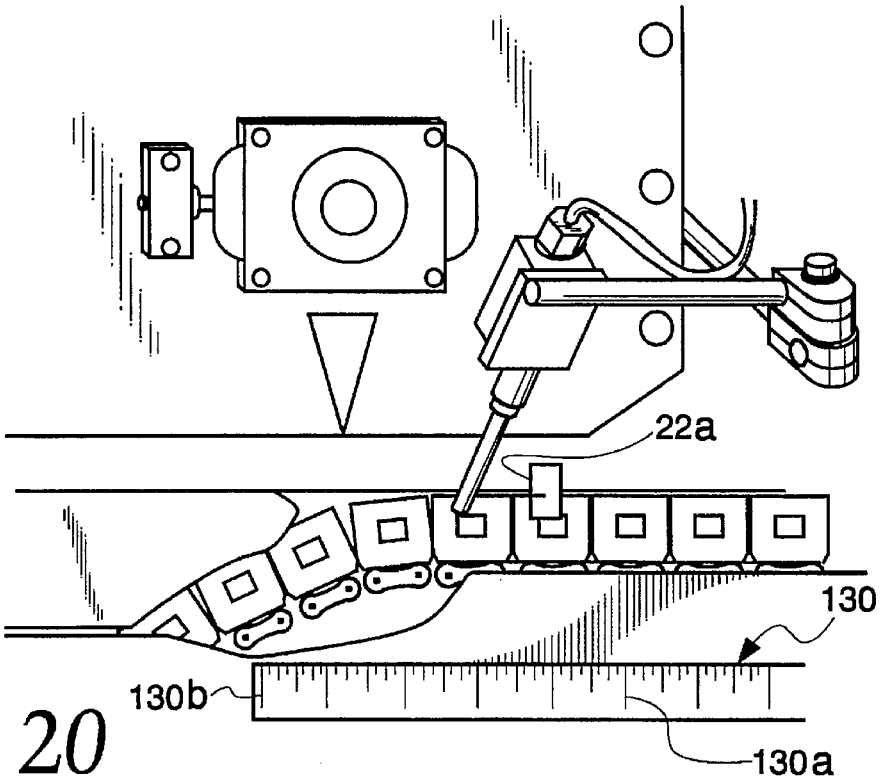
FIG. 20 is an enlarged view showing the single gathering chain lug timing scale.

Heretofore, the timing of the transfer conveyor 30 (FIG. 1) and its three transfer conveyor lugs 30*a* to the respective 32*a* (FIG. 17) on the double lug conveyor 32, and to the lugs 22*a* on the single lug conveyor 22 was difficult. With the present invention, however, there is provided a transfer station scale 120, as shown in FIG. 19, which extends generally horizontal with the scale units ascending from left to right. The preferred scale 120 is a flat strip which is located horizontally along a lower edge 121*a* of the transfer unit frame 121, and immediately above a transfer lug 30a which travels therebeneath, as shown in FIG. 19. The transfer lug 30*a* is an overhead lug in the sense that it is located above and travels in a plane above the lugs 22*a* (FIG. 17) on the gathering conveyor and above lugs 32*a* on the double gathering chain 32. To time the transfer station lugs, the main line drive has been previously locked out at the reference point of 100°, and the transfer conveyor has been disengaged from the main line drive. Then, using a transfer gathering chain hand adjustment wheel 122, the transfer conveyor lug 30*a* is moved along the scale 120 until its leading edge 30*b* is located beneath the indicia on the scale 120 for the particular length of untrimmed book form being fed. In this illustrated example of the invention, the length is 10". The indicia 120*a* on the scale 120 read from left to right in ascending order and are located apart ⅛". After positioning the lug 30*a*, the transfer conveyor is re-engaged to the main line drive.

Figure 17:
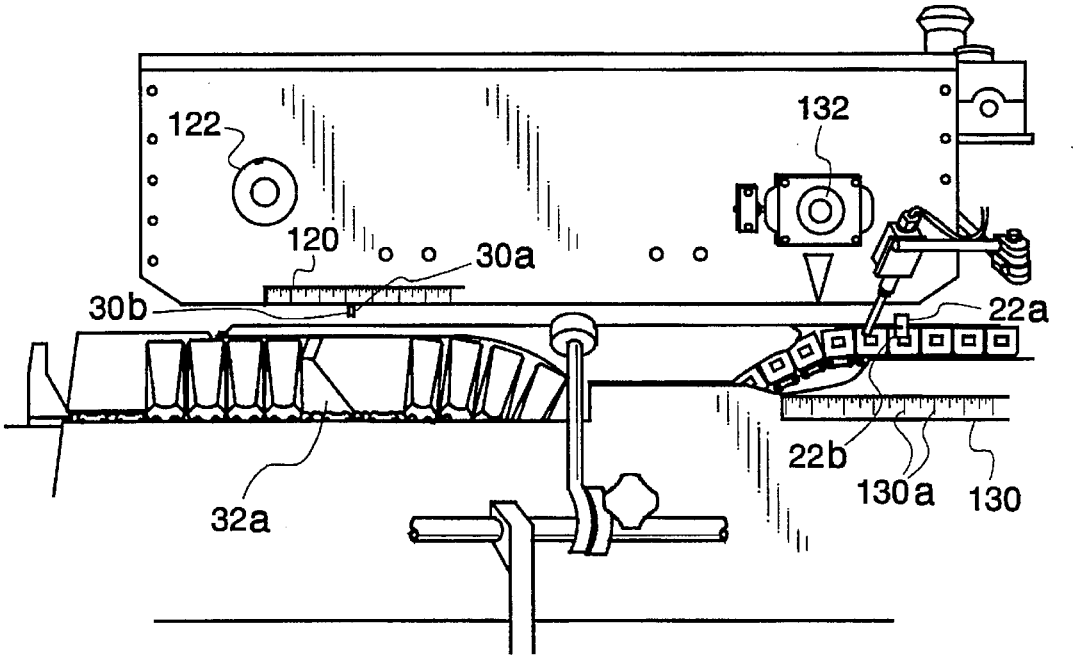
FIG. 17 is a view of the double lug and transfer scales.
Figure 21:
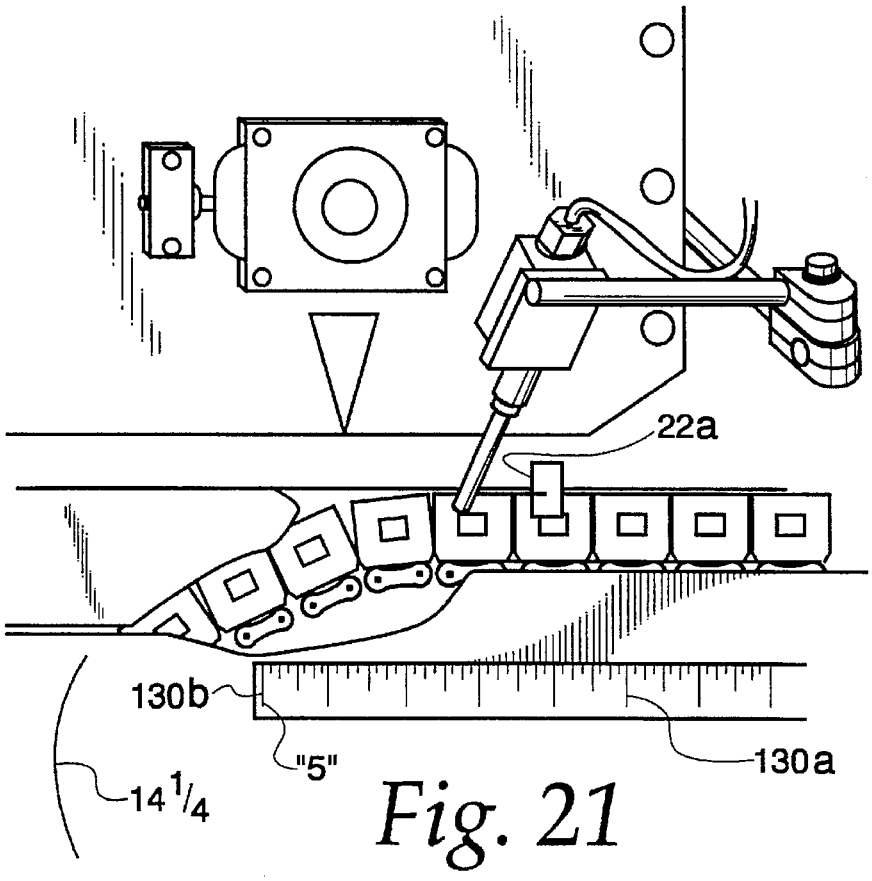
FIG. 21 is a view of a scale for the main line drive and reference point.

As best seen in FIG. 17, the transfer station scale 120 is located over the receiving end of the double lug gathering chain where the transfer conveyor is delivering the booklet form to the double gathering chain 32. As shown in FIG. 17, the single gathering chain lug 22*a* will next be set in its position relative to the transfer station lug 30*a* by the use of a single gathering chain timing scale 130 which has indicia 130*a* thereon. AS best seen in FIG. 21, the single gathering chain scale is located at 14¼" from a reference point to the indicia 5 at 130*b* on the scale 130 to locate the scale relative to where the reference point is when the machine is locked out at a reference of 100°. The single gathering chain lug 22*a* has its leading edge 22*b* set in the same manner as the previous settings by disconnecting the single gathering chain drive from the main line drive and using a hand adjustment bolt (not shown) to move the lug leading edge 22*b* to where a signature booklet has been placed along the scale at the appropriate indicia for the measured length. Thus, the leading edge 22b in the illustrated example for the 10" signature would have its leading edge 22b set opposite the indicia 10 on the scale 130 to time the lug 22a relative to the transfer conveyor lug 30a which has been previously timed. The single lug conveyor 22 is then re-engaged with the main line drive. The preferred scale 130 is located on a saddle plate 133, as best seen in FIG. 21, beneath the upper run of the single gathering chain lug 22a and adjacent the end of the single gathering chain conveyor's upper run. The preferred scale is a small, thin strip which is secured to the Muller saddle.

After having timed all of the lugs, they are in position to be timed to the drop from the signature feeder. As above explained, the gripper mechanisms have been set using the gripper cam scale 92 (FIG. 14) to set the gripper mechanisms 14a and 14 (FIG. 11) to drop to the lug 22a (FIG. 1) now at the position for this particular job. Thus, each of the conveyors used to gather and transport the signatures is set in precise locations without having to jog the machine and can be set simultaneously with other people setting their gripper mechanisms 14 and 14b (FIG. 11) for their respective pocket signature machines. It has been found that the scales used with these various conveyors eliminates the need for readjustment, and reduces the amount of time required to set up the chains, reduces the waste associated with errors occurred during set up. Additionally, of course, the amount of waste used when jogging and correcting and tweaking have been very substantially reduced by the use of the respective scales with their respective conveyors as above described.

Figure 10:
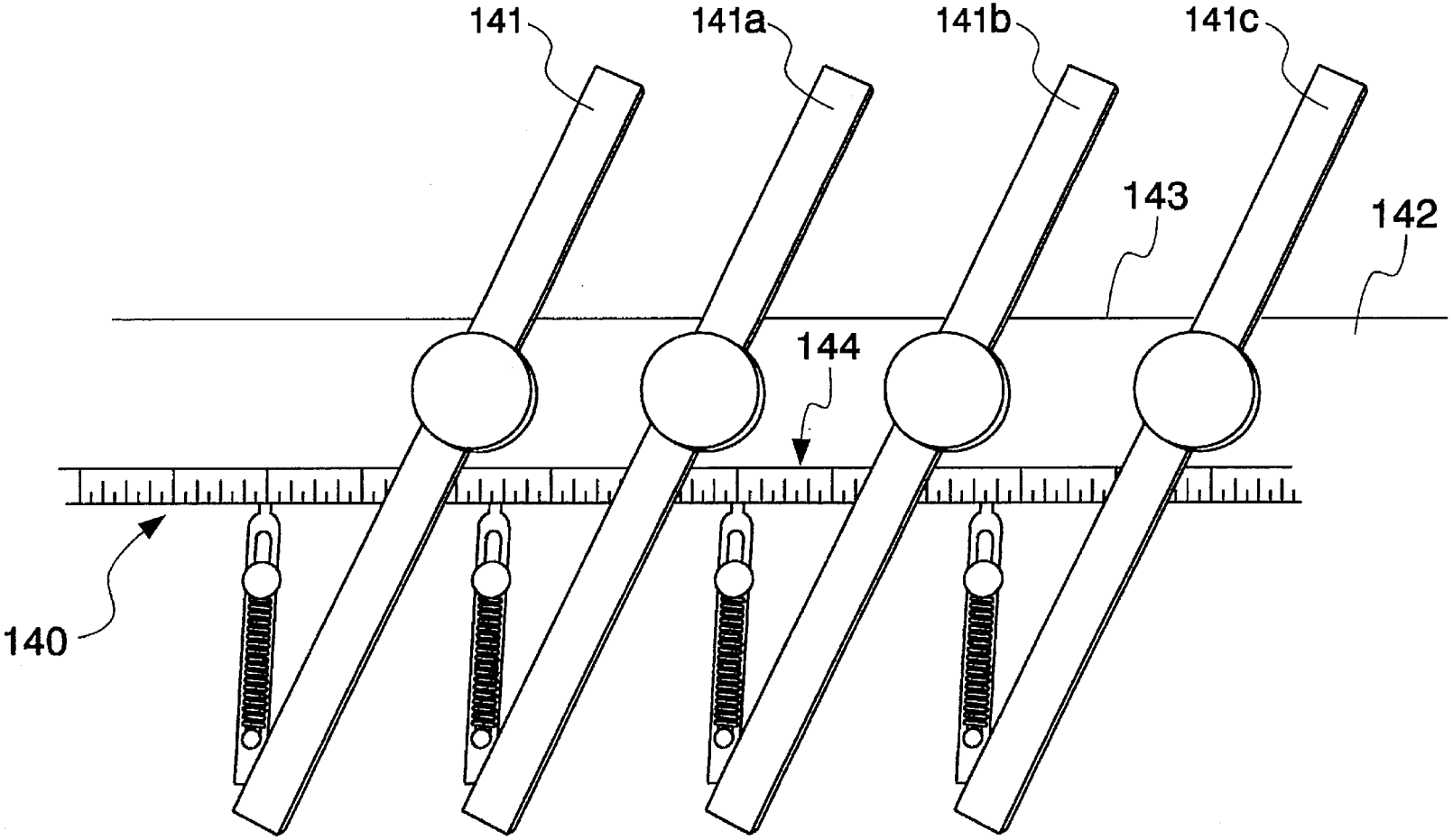
FIG. 10 is a partial view of the stitcher apparatus.

The double lug conveyor 32 (FIG. 16) delivers the booklet forms travelling along the saddle 20 (FIG. 25) into the stitcher's station 34 at which is located a stitcher carriage 140 (FIGS. 25 and 10) which has a plurality of stitcher heads 141 (FIG. 25) each of which is moveable along a frame 142 (FIG. 10) to an adjusted position relative to the saddle. The particular setting of the stitching heads is herein done ahead of time and is done by measuring the folded portion of the booklet between its foot and head and deciding at how many inches will be located in the stitches. Having decided and measured where the stitches are desired, then the respective stitcher heads 141 may be moved along a rail 143 to positions opposite an indicator scale 144 (FIG. 10) which has indicia thereon which are related to the size measurement of the respective head to foot measurement.

If a first stitcher head (FIG. 10) is to be located, for example, to make a stitch at two inches, the first stitcher head 141a will have a position along the rail of 143 adjusted until a book form edge from its centerline of the stitcher head is aligned with the indicia "2" on a scale 144 beneath the stitcher heads. If the other stitcher head 141b is to put a stitch at eight inches, then stitcher head 141b is moved along the rail 143 using the edge of a signature to align its centerline with the indicia 8 on the scale 144. Thus, there is no need to readjust the stitcher heads along the rails and to tweak them, as is sometimes done when using the conventional Muller stitcher which lacks the scale 144. Particularly, when there has been a previous job and the exact stitcher locations have been noted, the stitcher heads may be positioned during make-ready with the stitcher heads at the exact positions because of the scale 144 which is attached to the saddle also. The scale 144 is of actual size and is positioned so that the booklets receive the stitchers exactly where desired. The scale is a thin strip fixed in a horizontal stationary position on a frame member of the stitcher.

That is, rather than waiting until after they had produced product and measured the product and then doing readjustments, the stitcher heads may be set initially to the same positions previously used thereby eliminating any adjustments that were done heretofore using the machine in the conventional manner.

Figure 33:
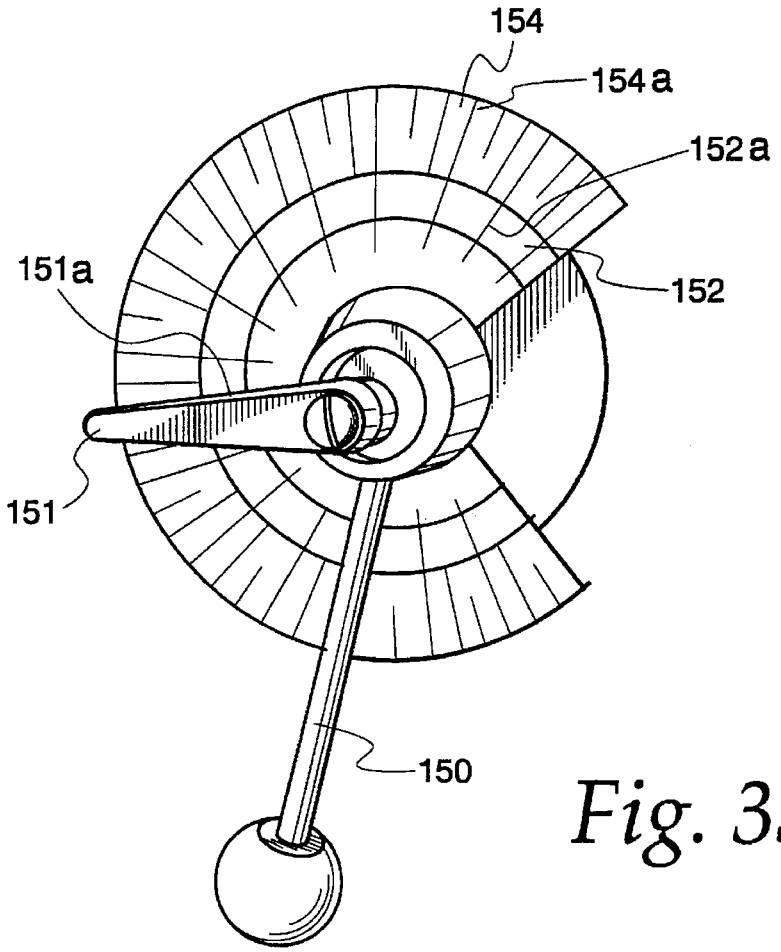
FIG. 33 shows a belt tension scale and belt tension adjustment handle.

At the trimmer machine, the book forms are fed by the in feed chain conveyor 38 (FIG. 24) to a position between a pair of upper belt conveyors 40a and a pair of lower belt conveyors 40b, which deliver the book forms to the trimming knives. The spacing between these respective upper and lower conveyor belts 40a and 40b is adjusted by using the so-called belt adjustment handle 150, as best seen in FIG. 33, which was used in conjunction with an inner scale 152 which had scale gradations 152a measured in ⅛ of an inch. The scale 152 is provided on the conventional Muller trimmer machines. However, the scale gradations 152a of ⅛ of an inch were related to an indicator 153. These gradations 152a were not found to be detailed enough because the belt tension could not be set very precisely, and again, it took some operator adjustment at different times to obtain the correct belt tension. A difference of eight sheets or less could not be easily detected or accounted for with the scale 152.

The adjustment of the spacing between belts 40a and 40b is achieved turning a locking lever 151 to its unlocking or loose position. At this position, the lever 150 may be rotated to bring the belts closer together or farther apart. When properly set, the locking lever 151 is turned in the reverse direction to its locking position to lock the lever 150 against inadvertent turning.

To alleviate the operator using judgment for the belt tension, an additional finer scale 154 has been provided to encircle the inner scale 152 which came with the machine. The scale gradations 154a on the scale 154 are at 1/64 of an inch and are used with the indicator 151. Thus, the operator may readily adjust the belt tension to a more precise position so that there is no need for any readjustment due to belt tension. This is another example of how to eliminate tweaking and how to eliminate the need for experience in the operator, particularly when running a job a second time. The operator will consult the job card 67 (FIG. 12) and take the reading off for the belt tension and set it accordingly using the indicator 151 and the fine gradation of 1/64 of an inch, which are indicated by the indicia 154a, to obtain a more precise control over the belt tension.

In accordance with the present invention, there is provided a simplified set-up of the book trimmer which will use scales for setting up head and foot knife assemblies as well as the face trimming assembly as will be described in great detail hereinafter. A trimmer can be set up properly and accurately without using a specific specified training of the operator, or the operator using a subjective judgment. The operator's subjective judgment and/or an operator's lack of experience often results in the need for later readjustments at the trimmer. This, of course, often results in waste and additional time used for tweaking and results in quality problem because of set up errors with the trimmer. With present invention, the trimmer can be set up to precise size by the finished product without having the product available and without having to jog the trimmer as with the prior conventional systems.

Figure 25:
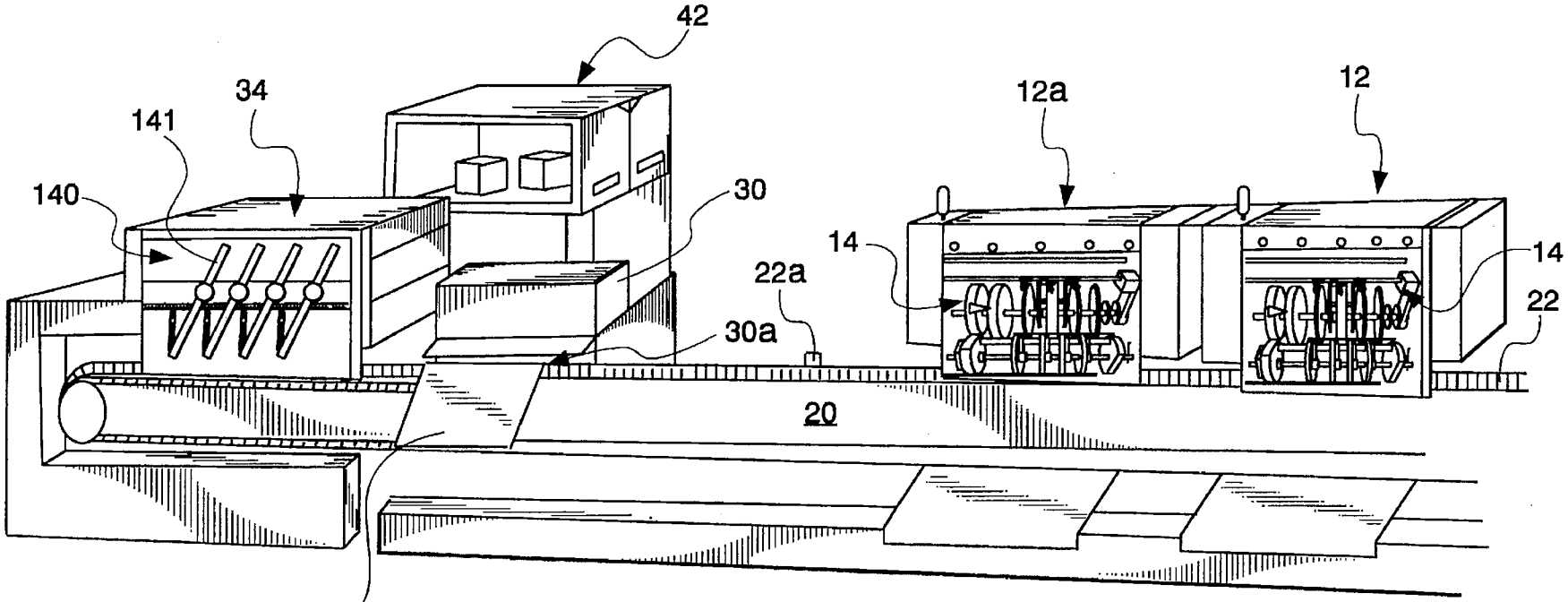
FIG. 25 is a perspective view of a bindery apparatus.
Figure 30:
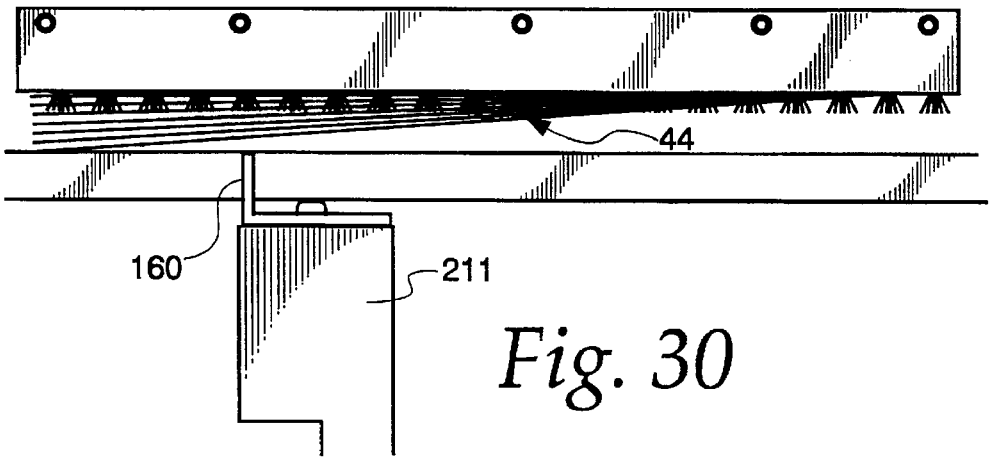
FIG. 30 is a side elevational view of a head and foot knife and a book form stop used in conjunction therewith.
Figure 29:
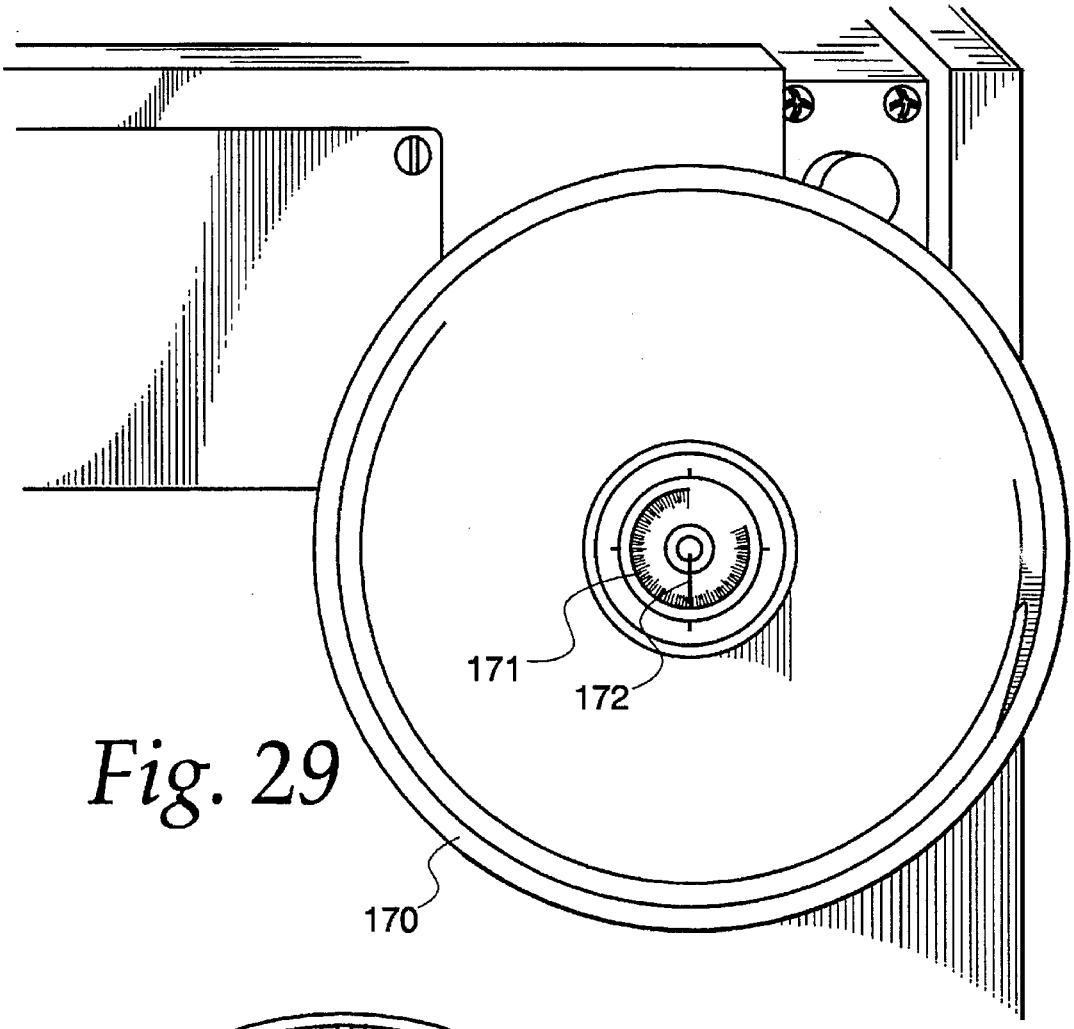
FIG. 29 is a view of a head and foot knife assembly hand wheel scale.

The signature book forms are conveyed by the infeed belt conveyor 38 (FIG. 24) into the space between the upper and lower belts 40 and 40a. These belts are brought together to feed the signatures to and against front, bookstops 160 (FIG. 30) which are connected to the rear bookstops 50 (FIG. 26), which will be described hereinafter. At the head and foot trimming stations, there are provided head and foot clamps and head and foot knife blades 44 and 46 (FIGS. 24 and 30). As best seen in FIG. 24, there is a foot clamp assembly 46, which is the left foot clamp assembly 163, as viewed there in FIG. 24, and there is a head clamp assembly 164, which is on the right, as viewed in FIG. 24. Both of these head and foot clamp assemblies are connected together by a common gear and screw assembly such that the respective head and slide assemblies are moved toward or away from each other through equal increments with turning of head and foot, adjustment hand wheel 170 (FIGS. 25 and 29).

In the conventional operation, the operator loosens knife assembly lock-down nuts 168 and 169 (FIG. 26) and then turns the head and foot knife assembly adjustment wheel 170 (FIG. 29) which had associated with it a scale 171 and an indicator 172. The operator would only use the head and foot, hand adjustment scale 171 to the approximate head and foot trim size because the scale and indicator were so inaccurate that they could not be relied upon. Rather than rely on the scale 171, the operator would use a tape measure to measure between the head and foot knives. This measurement was timeconsuming during make-ready. The measurement was very difficult to read due the visibility being obstructed by machine parts and hence, could be unreliable and the cause of considerable adjustments in calibrations. The Muller scale 171 operated off rotation of the screw and a considerable amount of wear or backlash could have occurred since the machine was new and the operator could not compensate for wear or backlash between the scale and knife assemblies. The operators would not rely or use the scale 171 except for an approximation and, of course, this approximation resulted in errors and the need for tweaking.

Figure 28:
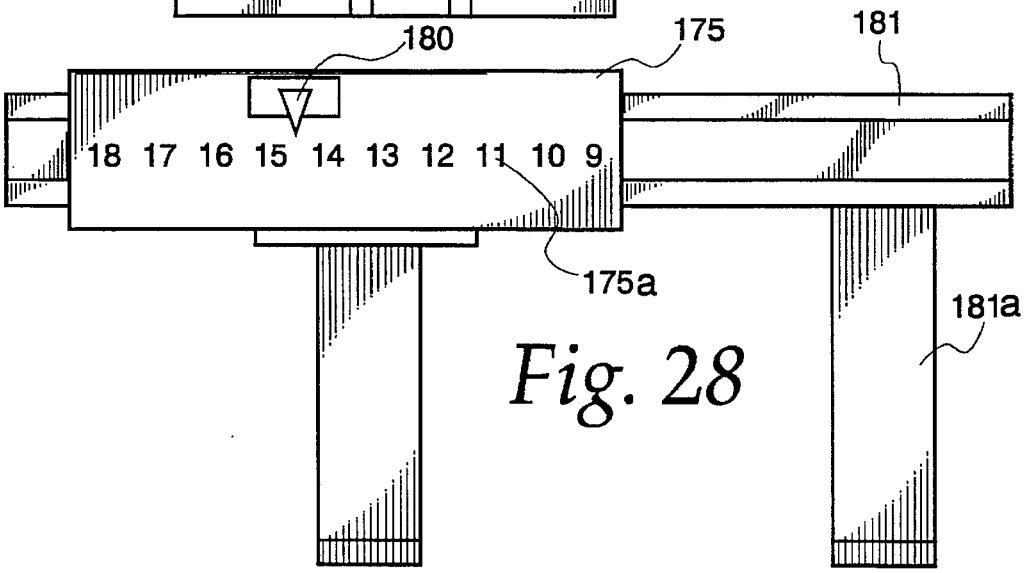
FIG. 28 is a front elevational view of the trimmer head and foot scale and indicator.

In accordance with the present invention, there is provided, as best seen in FIGS. 24 and 28, a head and foot scale 175 which is positioned on a yoke adjacent the top of the head and foot clamp assemblies 163 and 164. The head and foot knives are readily set to the size specified on the data sheet of the job card by first loosening the lock-down nuts 168 and 169 (FIG. 26). Then, the hand adjustment wheel 170 (FIG. 29) is turned to turn the screw and gear assembly to move the knife assemblies until the desired trim length on the data sheet card is indicated on the head and foot scale 175 (FIG. 28). Then, the knife assembly lock-down nuts 168 and 169 are tightened and the assembly is precisely positioned for trimming the head and foot of the sides of the signature.

Figure 27:
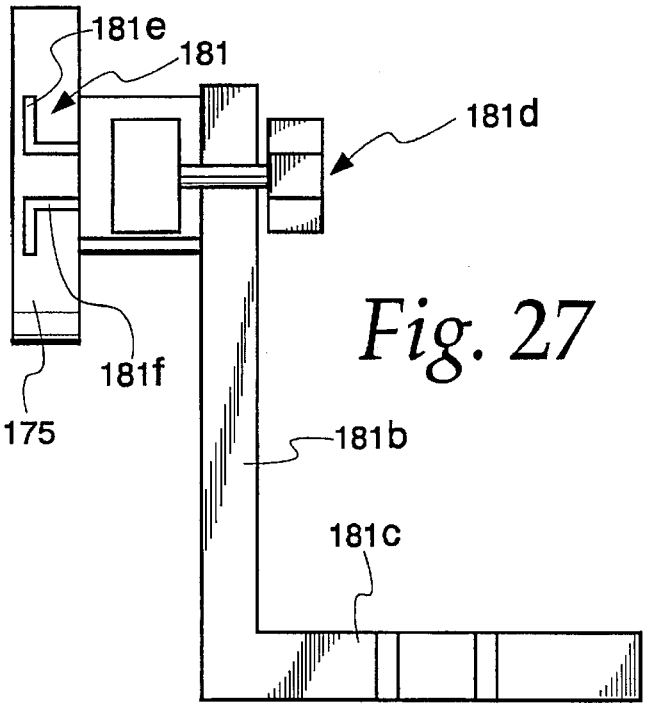
FIG. 27 is a side view of a scale and indicator for the trimmer head and foot.

As best seen in FIG. 28, the preferred head and foot scale 175 is plastic part, which has indicia 175*a* thereon, and which is connected to one of the foot and clamp assemblies 163 and 164 for movement therewith, whereas an indicator or pointer 180 is fixed to a horizontal aluminum rail 181 to be stationary. The rail is supported in a stationary position by trimmer brackets 181*a* which has a vertical leg 181*b*, as shown in FIG. 27, and a horizontal leg 181*c* to be connected to the stationary portion of the machine. The aluminum rail 181 projects laterally out at the top and is secured to the bracket by a bolt and nut assembly 181*d*. The nylon scale 175, as seen in FIG. 27, slides along an upper leg 181*e* and a lower leg 181*f* of the aluminum rail 181. Thus, in this instance, the scale 175 is movable relative to a fixed indicator 180. As before, except that now the setting is for the finished or trimmed size of the book, which can be known and measured leading the particular laps or edges to be trimmed, both at the foot and the head. Thus, the scale 175 is mounted to move directly with the knife assemblies and there is no loss motion by way of backlash as in with using the prior scale which did not work. After making the head and foot cuts, then the booklet is advanced and the face cut knife 52 (FIG. 26) makes the face cut with the book being abutted against face cut stops 50 (FIG. 26) of which there are several. In the conventional Muller trimmer machine, the face cut stops 50 may be adjusted by using a face cut adjustment, knurled knob 191 (FIG. 31) which had a cooperative scale 192. The face cut scale 192 used on the Muller machines was approximate and could not be easily kept in calibration. After a while, the operator would not use this book stop scale 192 because it was too inaccurate due to errors in backlash and also due to the fact that if the knife was sharpened, that the edge of the face cut knife 52 (FIG. 26) could be at different distance than the distance for which the scale 192 (FIG. 31) had been originally calibrated.

Figure 31:
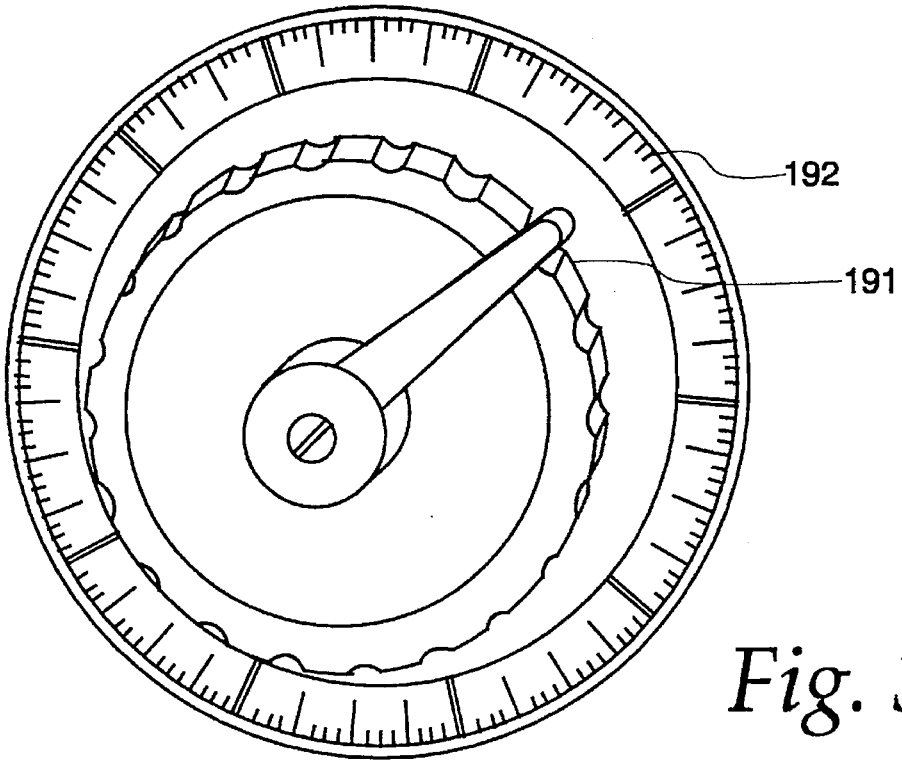
FIG. 31 is an enlarged face cut scale indicator and adjustment handle.
Figure 32:
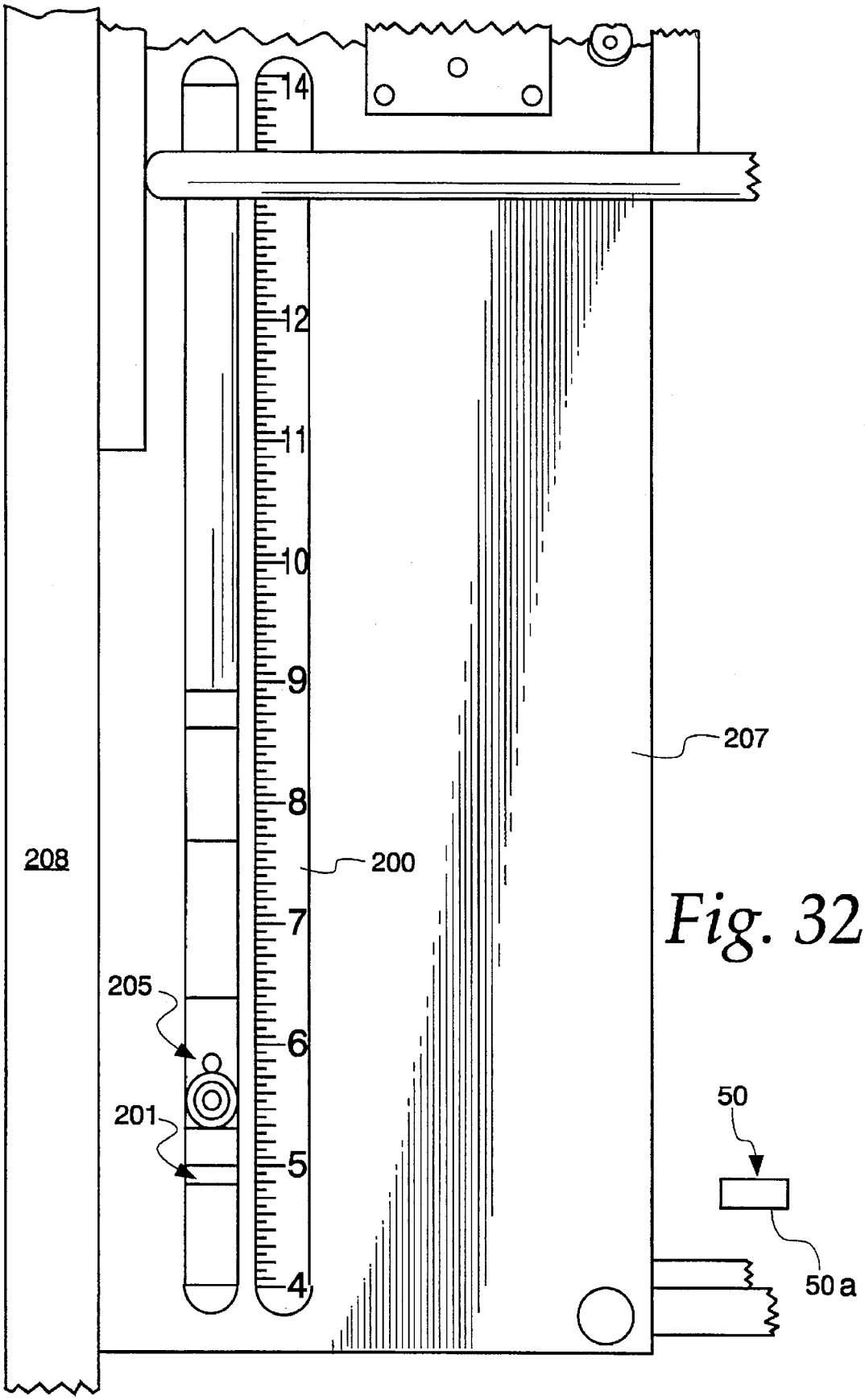
FIG. 32 illustrates a trimmer face cut scale indicator a stop indicator for the scale.
Figure 32A:
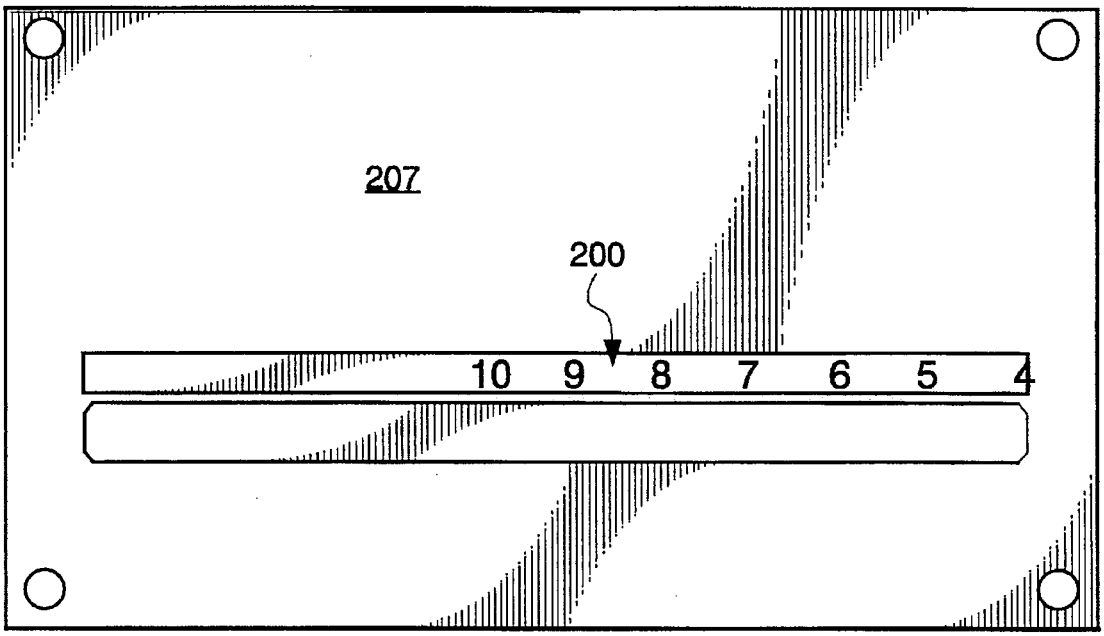
FIG. 32A shows the trimmer face cut scale location.

In accordance with the present invention, there is provided a face cut trimmer scale 200 (FIG. 32) and a movable trimmer face scale indicator 201 which is movable along and indicates the particular location of the forward edges 50*a* of face cut paper stops 50. A plurality of paper stops 50 are mounted on a common bar and this bar is now been provided with an additional stop 205 which carries the indicator pointer 201. This additional stop 205 is mounted on a common bar carrying the paper stops 50 that additional stop 205 moves relative to the indicator scale 200 with stops 50. The indicator scale 200 is located so that it is readily visible at the rear view of the machine as shown in FIG. 26. The indicia on the scale 200 are set at the actual sizes and 1/16th of an inch and they are measured exactly from the knife edge of the face cut knife so that there is no difference due to the particular loss with the change of sharpening of a knife or the like or in backlash between the gear mechanism which is caused when rotating the adjustment face cut knob 191 (FIG. 31). The illustrated and preferred trimmer face cut scale 200 is a small, thin strip which is affixed to a horizontal plate 207 which has been mounted to the trimmer frame 208, as best seen in FIG. 32.

It should be pointed out that the other book stop 160 (FIG. 30) used to stop a following book form during a head and foot trim is carried on a bar or rail 211, which is directly connected to the head stops 50, 205, so that by moving the face cut paper stops 50, 205 to their desired position, for example, at indicia 10 on the scale 200 for a 10" book, causes the stop 160 to be likewise positioned exactly for a 10" book cut.

Figure 18:
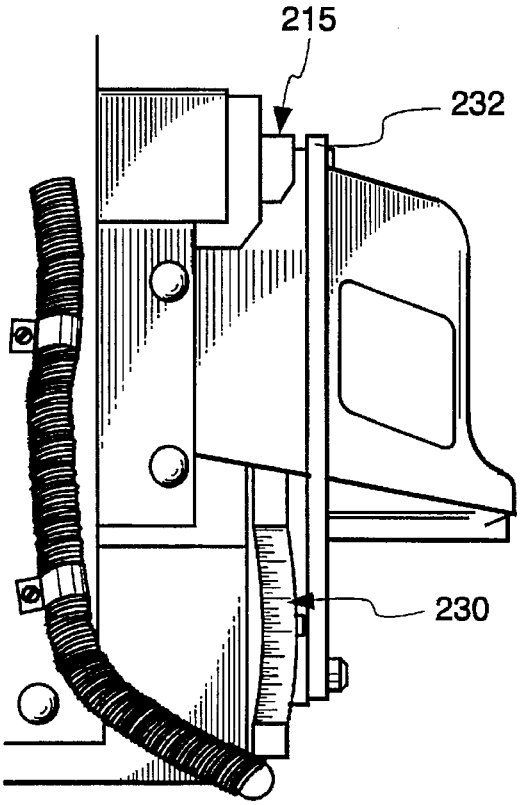
FIG. 18 illustrate a scale associated with the yoke timing of the face cut.
Figure 34:
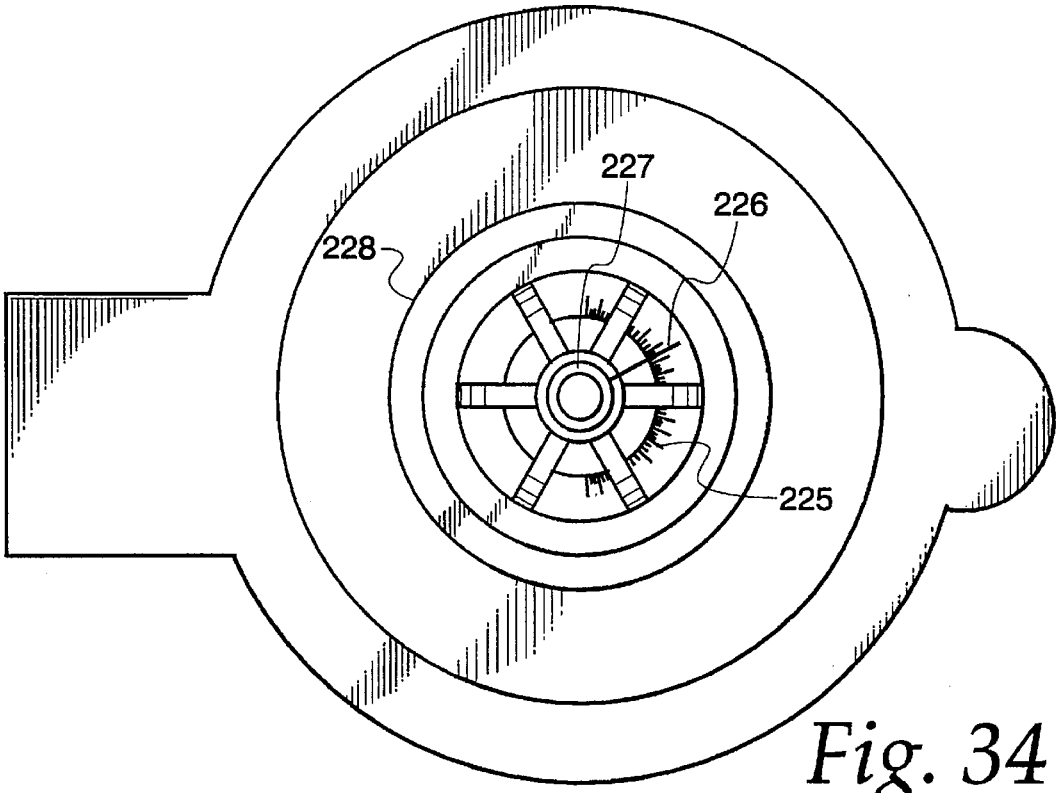
FIG. 34 shows a conventional trimmer face cut adjustment scale and a disconnection coupling for the yoke.

One of the more difficult tasks and one that required considerable amount of tweaking or adjustment was for the operator to adjust the drive or the timing of the yoke 215 (FIG. 18) with the head, foot and face knives thereon to the infeed conveyor 38 (FIG. 24) which had lugs thereon which were pushing the book form toward the stops 160. In a conventional machine, the operator would estimate the amount of drive needed and would readjust until the desired drive was obtained. The Muller machine had a scale 225, as best seen in FIGS. 1 and 34, which cooperated with a scale indicator 226 (FIG. 34). The Muller machine also had a rotatable knob 227 (FIG. 34) which could be turned to connect or disconnect the yoke 215 to the common drive for the lug infeed conveyor 38. There was also a trimmer adjustment hand wheel 228 which was turned, after loosening the connection with rotation of the knob 227, to turn a screw and gear mechanism to adjust the vertical position of the yoke 215 (FIG. 18), and hence, position of the knives thereon relative to the position of the lugs on the timing infeed chains 38 (FIG. 24). The problem was that the screw and gear mechanism for the trimmer drive often became loose and or developed. The scale needed to be recalibrated, but this was very difficult for the operators. The Muller scale suffered in that there was a number of gears which became worn and screw shafts which became worn and there was backlash such that the scale was not measuring accurately and was not used except for approximations. The drive adjustment hand wheel 228 (FIG. 1) was located on the outer side and lower edge of the trimmer a long way from the yoke 215, which was up at the top of the machine and which was at the center portion of the machine rather than at the side where the hand wheel 228 (FIG. 1) is located.

This distance and all of the gear and screw mechanisms in between contributed to the drive adjustment trimmer scale 228 being ineffective. Further, the indicia on the scale 225 were not directly related to the particular size and were really just relative measurements rather than actual related to a particular size or signature.

Figure 35:
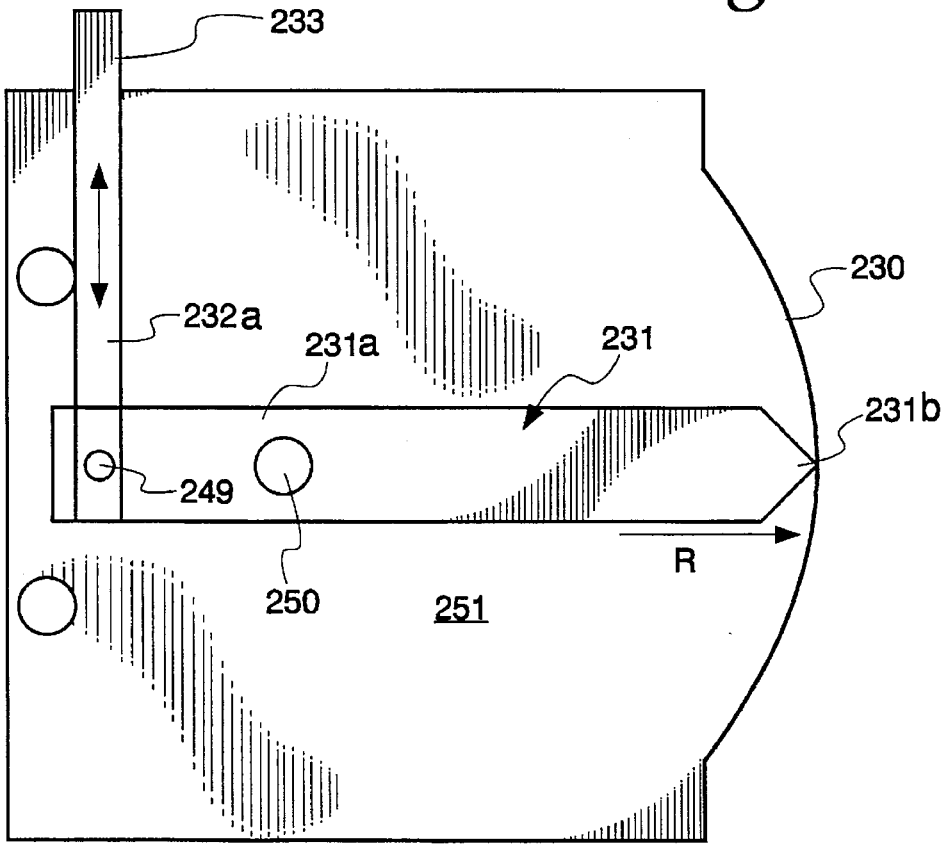
FIG. 35 shows a new trimmer drive scale.
Figure 36:
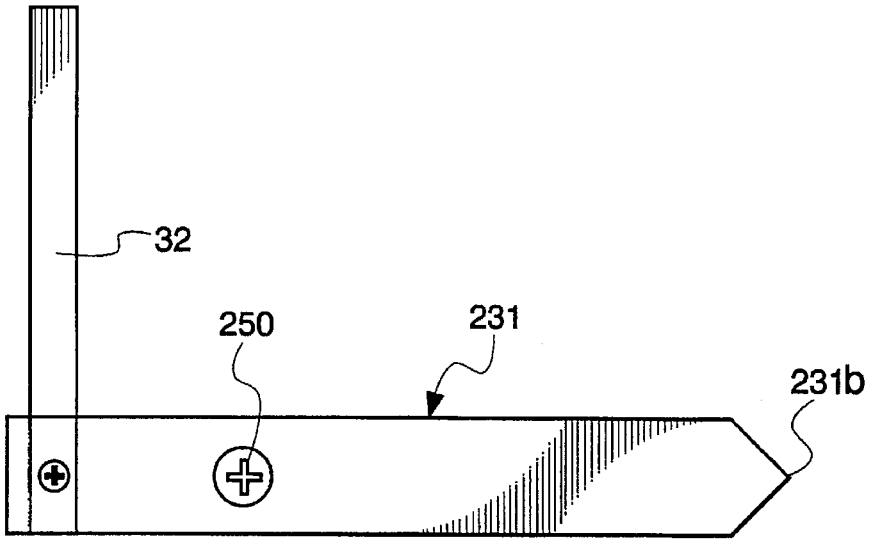
FIG. 36 shows a pivoted indicator.
Figure 37:
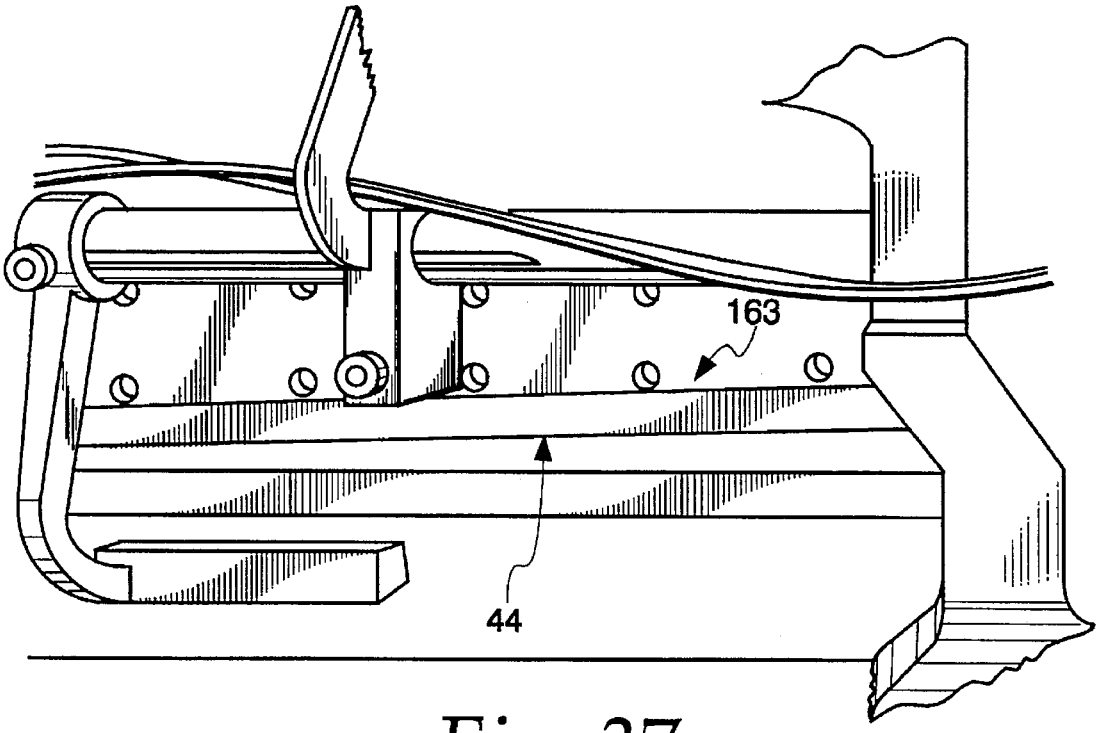
FIG. 37 shows a head and foot knife.

In accordance with the present invention, the drive adjustment is obtained quickly and easily and accurately by turning the drive adjustment hand wheel 228 until the measured size, for example, number 10 on a scale 230 (FIGS. 1 and 18), is obtained and by a movable indicator or pointer 231 which is moved by a pusher 232 which is connected to the yoke 215 as shown in FIGS. 26, 35 and 36. As best seen in FIG. 26, the left side of the yoke 215 has a horizontally extending bracket 247 which is connected to the pusher rod 232, which extends downwardly along the side of the yoke and is connected at its lower end 232*a* to an outer end of the pointer 231. More specifically, as best seen in FIG. 35, the pusher 232 moves vertically as indicated by the arrow and it has a pivot pin connection 249 to the end 231*a* of the pointer 231 which has a central stationary pivot 250 fixed to the trimmer frame 251 and mounting the indicator for pivotal movement with the vertical movement of the pusher 232. The pointer has a fine pointed edge 231*b* which moves along and indicates on a arcuate scale 230. As can be seen from FIGS. 18 and 35, the arcuate scale is mounted on a circle or arc having a radius R of 34 inches and is gradated with ¼ inch marks on the scale. The drive scale is calibrated for the particular timing relative to a given signature size.

When the machine is locked out a 100°, the infeed lugs 38*a* are at a known position and the yoke 215 is disconnected and moved vertically to the desired face cut distance as indicated by the pointer 231 on the scale 230. At this vertical position, the knives and yoke will be at a height related to the lugs on the infeed conveyor 38 such that the signatures will abut against the head and foot stop 160 and with the preceding signature being with its folded edge abutting against the face cut stops 50. The mathematics are such that the scale and the drive are directly related to the measured size using the vertical displacement of the yoke to pivot indicator 230 through a distance related proportionally to the size of the trim, which in this example, because of the particular machine, is on a 34-inch radius with a quarter inch marks on the scale. Herein, the yoke had a 3.25 inch stroke and the lever pointer is 5.76 inches in length from the pivot axis 250 to the point 231*b*. The 3.25 stroke was projected out to be 5.43 and this was laid out on arcuate surface 230 (FIG. 18) which arcuate surface is cut at a 34-inch radius. In any event, the mathematics are used to provide a scale 230 wherein the actual book length, e.g., 10 inches can be set at an indicia 10 on the scale 230 and the yoke will be adjusted proportionally in the vertical direction a proportional portion of its total stroke, to give a 10-inch trimmed book form length upon completion of its cutting stroke. If the pointer is moved to a 9-inch indicia on the scale 230, then the yoke is also moved proportionally in the vertical direction that upon completion of its downward stroke it will have severed a 9-inch trimmed book form. Thus, the operator is able to set the particular drive scale indicator and yoke using the drive adjustment hand wheel 228 and generally ignoring the Muller scale 225. This eliminates much of the operator error which was caused when trying to rely on an inaccurate Muller scale 225.

From the foregoing, it will be seen that the scales allow objective measurements by which to collect and store data from a previous operation onto the job cards which then can be used to provide a faster and better trimmer machine set up at a later date. The objective is to provide a trimmer machine which when it takes the same job again, operates as if it was continuing the first job as it was first run. The invention allows reduction of the initial set up time and a reduction of the initial production run time. The persons may measure a signature to obtain the positioning of their parts while the machine is locked out at 100° which is the reference point without having to do any substantial jogging as the was the practice heretofore.

Thus, it is seen that the particular set ups for the thickness of the pocket drops and the timing of the respective conveyors, the positioning of the stitcher heads and in particular the positioning of the stops and the location of the trimmer knives and the timing thereof to the infeed conveyor are readily established in an objective manner.

What is claimed is:

1. A trimmer apparatus for use in a bindery process to trim book forms comprising:

a frame;

infeed conveyors having lugs and for conveying book forms to and through head and foot trimming station and for conveying book forms to and through a face trimming station;

a knife carrying, movable frame member mounted for timed vertical movement in the frame;

a motor drive in the trimmer apparatus for shifting the movable frame member and the in feed conveyor lugs in timed relationship to each other; and a scale and indicator therefor mounted on the trimmer apparatus and having indicia related to the true trimmed distance between the fold and the face cut so that the movable frame member may shifted vertically to a position used before for this trimmed distance.

2. A trimmer apparatus in accordance with claim 1 wherein stops are provided to stop the book form during cuts; and a scale is mounted on the trimmer apparatus adjacent the stops with indicia related to the true distance between the stops and the face cut knife so that the stops may be set to indicia related to the true trimmed size for the book form.

3. A trimmer apparatus in accordance with claim 2 wherein the scale is a linear scale which is located adjacent the rear book form stops and extends longitudinally in the direction of travel of the book forms; and an indicator is associated with the rear book stops to indicate indicia on the scale that is the true trimmed dimension for the book forms.

4. A trimmer apparatus in accordance with claim 1 wherein the movable vertical frame member moves through a predetermined vertical stoke related linearly to a predetermined travel distance for the infeed conveyer lug;

a movable indicator is attached to the movable frame member for movement therewith; and the scale has its indicia spaced proportionally to the movable indicator so that a vertical displacement of the movable members shifts the indicator to an indicia on the scale that is the measured true trim dimension for the book form between its face and fold time.

5. An apparatus in accordance with claim 4 wherein the movable indicator comprises a vertically extending actuator member and a pivoted pointer which is mounted on a stationary portion of the frame.

6. A trimmer apparatus for use in a bindery process to trim book forms comprising:

a frame;

infeed conveyors having lugs and for conveying book forms to and through head and foot trimming station and for conveying book forms to and through a face trimming station;

a knife carrying, movable frame member mounted for timed vertical movement in the frame;

a motor drive in the trimmer apparatus for shifting the movable frame member and the infeed conveyor lugs in timed relationship to each other;

a scale and indicator therefor mounted on the trimmer apparatus and having indicia related to the true trimmed distance between the fold and the face cut so that the movable frame member may shifted vertically to a position used previously for this trimmed distance;

a scale having indicia directly related to the size of the trimmed dimension; and an indicator for use with the scale and indicia so that the book form stops may be set during make-ready to the trimmed distance from the face knife.

7. An apparatus in accordance with claim 6 wherein the indicator is an extra stop having an indicator portion aligned with the book engaging surfaces on the book form stops.

8. An apparatus in accordance with claim 7 wherein the scale is a flat linear strip located in the longitudinal travel direction of the books and has indicia thereon indicating the true distance from the face cut knife.

9. An apparatus in accordance with claim 6 wherein another scale and indicator are provided with indicia related to the true trimmed size the scale being associated with the frame movable member which carrying the face knife so that movement of the frame member vertically to an indicia for the trimmed face dimension provides a timed make-ready of the infeed conveyor lug to the face knife.

10. A method of making ready a trimmer apparatus having an infeed conveyor with lugs and a movable frame member carrying a face knife, said method comprising the steps of:

providing a measured distance for the trimmed book form between its fold and the face cut after removal of lugs;

disconnecting the drive between the movable member and the infeed conveyor with the lug while the trimmer is at a predetermined reference position;

shifting the movable frame member vertically while disconnected from the drive to a position associated with the indicia for the measured distance and reconnecting the movable frame member to the drive;

shifting book form stops longitudinally in the direction of book form travel to indicia for the measured distance, said indicia indicating the true distance between the book stops and the face cut knife.

11. a method in accordance with claim 10 including the step of rotating the indicator which is connected to the movable member to swing the indicator about indicia on the stationary scale.

12. A method in accordance with claim 10 including the step of moving an extra book stop serving as an indicator along a linear scale mounted to the stationary frame of the machine.

13. A method in accordance with claim 10 including the steps of:

providing a finer resolution scale about a coarser resolution scale; and positioning upper and lower infeed conveyor belts at distances related to the thickness of the book form while using the finer resolution scale.

* * * * *

UNITED STATES PATENT AND TRADEMARK OFFICE

CERTIFICATE OF CORRECTION

PATENT NO. 5,660,515

DATED August 26, 1997

INVENTOR(S) Hartsoe

It is certified that error appears in the above-indentified patent and that said Letters Patent is hereby corrected as shown below:

Column 18, line 42, after "member" change "may shifted" to --may be shifted--.

Column 18, line 61, after "vertical" change "stoke" to --stroke--.

Column 19, line 23, change "may shifted" to --may be shifted--.

Signed and Sealed this

Second Day of December, 1997

*Attest:*

*Attesting Officer*

Bruce Lehman

BRUCE LEHMAN

*Commissioner of Patents and Trademarks*